US006234677B1

(12) United States Patent
Mogil

(10) Patent No.: US 6,234,677 B1
(45) Date of Patent: May 22, 2001

(54) DIVIDED INSULATED CONTAINER

(75) Inventor: Melvin S. Mogil, Toronto (CA)

(73) Assignee: California Innovations Inc., Willowdale (CA)

( * ) Notice: Subject to any disclaimer, the term of this patent is extended or adjusted under 35 U.S.C. 154(b) by 0 days.

(21) Appl. No.: 09/323,202

(22) Filed: Jun. 1, 1999

Related U.S. Application Data

(63) Continuation-in-part of application No. 09/199,287, filed on Nov. 25, 1998.

(30) Foreign Application Priority Data

Nov. 25, 1998 (CA) ..... 2254687

(51) Int. Cl.[7] ..... B65D 30/02; B65D 30/22

(52) U.S. Cl. ..... 383/110; 383/38; 383/111; 206/545; 206/546

(58) Field of Search ..... 383/110, 111, 383/38, 39, 901; 150/113, 117; 190/109, 110, 111; 206/541, 544, 545, 546

(56) References Cited

U.S. PATENT DOCUMENTS

| | | | | |
|---|---|---|---|---|
| D. 273,533 | | 4/1984 | Wienreb . | |
| D. 328,550 | | 8/1992 | Mogil . | |
| D. 340,387 | | 10/1993 | Melk . | |
| D. 373,515 | | 9/1996 | Melk . | |
| D. 375,835 | | 11/1996 | Christopher et al. . | |
| D. 382,771 | | 8/1997 | Mogil . | |
| D. 382,772 | | 8/1997 | Mogil . | |
| D. 387,249 | | 12/1997 | Mogil . | |
| D. 389,704 | | 1/1998 | Yousko et al. . | |
| D. 414,379 | | 9/1999 | Haberkorn . | |
| 1,372,893 | * | 3/1921 | Miller | 383/901 X |
| 1,826,646 | | 5/1931 | Blake . | |
| 1,985,111 | | 12/1934 | Shofer et al. . | |
| 2,555,788 | | 6/1951 | Donaldson . | |
| 2,610,472 | | 9/1952 | Maxwell . | |
| 2,645,332 | | 7/1953 | Martin et al. . | |
| 2,770,275 | * | 11/1956 | Suciu | 383/110 X |
| 2,880,775 | | 4/1959 | Beattie . | |
| 3,255,607 | | 6/1966 | Bair et al. . | |
| 3,572,054 | | 3/1971 | Curcio . | |
| 3,998,072 | | 12/1976 | Shaw . | |
| 4,010,784 | | 3/1977 | Nattrass . | |
| 4,050,264 | | 9/1977 | Tanaka . | |
| 4,091,852 | | 5/1978 | Jordan et al. . | |
| 4,210,186 | * | 7/1980 | Beleson | 190/110 X |
| 4,260,004 | * | 4/1981 | Domke | 190/110 X |
| 4,286,440 | | 9/1981 | Taylor . | |
| 4,334,601 | * | 6/1982 | Davis | 190/111 X |
| 4,468,933 | * | 9/1984 | Christopher | 383/110 X |
| 4,499,998 | | 2/1985 | Carlson . | |
| 4,499,999 | * | 2/1985 | Behar | 206/546 |
| 4,506,769 | * | 3/1985 | Franco et al. | 190/110 X |
| 4,509,645 | | 4/1985 | Hotta . | |
| 4,521,911 | | 6/1985 | Vance . | |

(List continued on next page.)

FOREIGN PATENT DOCUMENTS

| | | |
|---|---|---|
| 2149491 | 5/1995 | (CA) . |
| 2 025 593 | 1/1980 | (GB) . |

*Primary Examiner*—Jess F. Pascua
(74) *Attorney, Agent, or Firm*—Arent Fox Kintner Plotkin & Kahn, PLLC

(57) ABSTRACT

A portable soft sided insulated container has an impermeable liner that provides a liquid holding barrier. The liner is folded from a single monolithic plastic sheet to reduce or eliminate the need for heat welded seams. The liner seats within the container and has a releasable attachment around its lip for mating with the rim of the container. The container has an insulated lid so that the entire assembly may be closed. The liner can be removed for cleaning, or replacement if punctured. When not in use the entire assembly can be folded into a collapsed position for storage. The container has two storage chambers that share a common insulated dividing wall.

29 Claims, 30 Drawing Sheets

U.S. PATENT DOCUMENTS

| | | | | |
|---|---|---|---|---|
| 4,537,313 | | 8/1985 | Workman . | |
| 4,541,540 | | 9/1985 | Gretz et al. . | |
| 4,551,988 | | 11/1985 | Petrantoni . | |
| 4,598,746 | | 7/1986 | Rabinowitz . | |
| 4,610,286 | | 9/1986 | Cyr . | |
| 4,655,052 | | 4/1987 | Garcia . | |
| 4,673,117 | | 6/1987 | Calton . | |
| 4,679,242 | * | 7/1987 | Brockhaus | 383/110 X |
| 4,706,856 | | 11/1987 | Jacober . | |
| 4,759,467 | * | 7/1988 | Byrne | 383/38 X |
| 4,796,758 | | 1/1989 | Hauk . | |
| 4,819,793 | | 4/1989 | Willard . | |
| 4,858,444 | | 8/1989 | Scott . | |
| 4,871,069 | * | 10/1989 | Guimont | 383/110 X |
| 4,916,923 | | 4/1990 | Adams et al. . | |
| 4,923,060 | | 5/1990 | Breslau . | |
| 4,929,094 | | 5/1990 | Becker . | |
| 4,941,603 | * | 7/1990 | Creamer et al. | 190/111 X |
| 4,974,966 | | 12/1990 | Fabbi . | |
| 4,984,662 | | 1/1991 | Jacober . | |
| 5,050,399 | | 9/1991 | Peahl . | |
| 5,090,526 | | 2/1992 | Jacober . | |
| 5,095,718 | | 3/1992 | Ormond et al. . | |
| 5,149,203 | | 9/1992 | Sacks . | |
| 5,313,807 | | 5/1994 | Owen . | |
| 5,328,265 | | 7/1994 | Clooney . | |
| 5,354,131 | | 10/1994 | Mogil . | |
| 5,356,004 | * | 10/1994 | Wienreb | 190/110 X |
| 5,400,610 | | 3/1995 | Macedo . | |
| 5,472,279 | * | 12/1995 | Lin | 383/110 X |
| 5,501,338 | | 3/1996 | Preston . | |
| 5,505,307 | * | 4/1996 | Shink | 206/545 X |
| 5,562,228 | | 10/1996 | Ericson . | |
| 5,660,476 | | 8/1997 | DeCoster . | |
| 5,718,124 | | 2/1998 | Senecal . | |
| 5,820,268 | | 10/1998 | Becker et al. . | |
| 5,842,571 | * | 12/1998 | Rausch | 206/541 X |
| 5,857,778 | | 1/1999 | Ells . | |
| 5,865,314 | | 2/1999 | Jacober . | |
| 5,904,230 | | 5/1999 | Peterson . | |
| 5,924,303 | | 7/1999 | Hodosh . | |

* cited by examiner

DIVIDED INSULATED CONTAINER

This application is a continuation-in-part of U.S. patent application Ser. No. 09/199,287 filed Nov. 25, 1998.

FIELD OF INVENTION

This invention relates to the field of soft sided insulated containers. In particular it relates to soft sided insulated containers having a division between zones to permit different environments to be established in different zones.

BACKGROUND OF THE INVENTION

In recent times soft sided insulated containers have become popular for carrying either articles that may best be served cool, such as beverages or salads, or warm, such as appetizers, hot dogs, and so on. Such containers are frequently used to carry liquids, whether hot liquids, such as soup containers, coffee or tea, or cold liquids such as beer pop, juices and milk. The containers are typically made in a generally cube like shape, whether of sides of equal length or not, having a base, four upstanding walls, and a top. The top is generally a lid which opens to permit articles to be placed in, or retrieved from, the container.

By the nature of their use, it is advantageous for the containers to be water tight. That is, whether to hold melted run-off from ice cubes or to hold spilled liquids, the container must be sufficiently liquid tight that it does not leave a trail of drips, or become moist or sticky to the touch of a person carrying the container.

The present inventor has found it disadvantageous to try to seal the container itself. Some types of insulating wall are sewn at their seams. Sewn seams have a tendency to leak at the stitches. Another approach is to fold the insulated blanket from which the container is made, to present an assembly that, through folding, has no seams. This is also disadvantageous, in the present inventor's view, because the insulated blanket used to form the container walls is relatively thick. The thick material may not tend to make a compact fold. It would be preferable to form an impermeable layer that has a relatively thin wall thickness so that the resulting product does not look bulky and cumbersome.

It is also advantageous to be able to clean the inside of the insulated container. Spilt liquids may not always have the most attractive air when allowed to dry, and may cause the inside of the container to become unsightly. It is possible to provide a plastic liner for soft sided insulated containers. A see-through plastic liner can be made of the minimum amount of material by using only a single layer, and forming seams where the edges of the material meet. A common method of forming such a seam is to weld two adjacent edges together by heating. However, an existing liner of this type is known to have had a tendency for the heat welded seams to develop leaks over time. It would be advantageous to reduce or eliminate the number of heat welded seams formed in areas of the liner that may need to be water tight.

In general, manufacture of an assembly of this type emphasizes cost reduction. One common source of cost savings is a reduction of the raw material used. However, the present inventor has observed, counter-intuitively, that the overall benefit an increase in raw material use can outweigh the cost saving that would otherwise be achieved. Unexpectedly, the use of a greater amount of material in a folded assembly has been found to be advantageous, and has eliminated the need to have a heat welding station in manufacture.

It may also be that, along with objects to be carried in a leak proof chamber at one temperature, another type of good may also be desired, requiring a different environmental condition. For example, it may be inconvenient for persons going to a picnic to carry a different insulated container for each type of food. They may prefer a single container that permits more than one type of food to be carried. That is, it may be preferable to have one zone in the insulated container for a cold, or very cold item, such as ice cream, and another zone for cool items, such as fruit or drinks. Alternatively, one zone may contain canned drinks in ice, while another zone contains warm or hot foods such as pizza or hamburgers. Temperature is not the only determinant factor. For example, while an ice filled zone may be damp inside, other objects, such as bread or some fruits and vegetables, may need a less moist environment.

The proportion of the types of objects to be placed in the container may not always be the same. In those situations, it may be advantageous to be able to alter the relative proportions of the volumes of the zones. It may also be advantageous to provide a stabilizer to segregate items, or to discourage items from shifting during transport.

SUMMARY OF THE INVENTION

In an aspect of the invention there is a soft-sided insulated container, and a removable liner for placement inside the container. The liner is folded from a monolithic sheet of liner stock to define a chamber, capable of holding liquids. The liner is free of heat welded seams.

In another feature of that aspect of the invention the liner is made from a water impermeable plastic sheet. In an additional feature of that aspect of the invention the liner is made from a translucent static cling vinyl sheet. In another additional feature of that aspect of the invention the soft sided insulated container has a base, sides and a top. The liner has a base, sides for placement inside and adjacent to the base and sides of the container. The top of the container is moveable to an open position to permit articles to be placed in the chamber.

In still another additional feature of that aspect of the invention the chamber has an opening, the opening having a lip, and the liner is mated to the cooler about the lip. In yet another additional feature of that aspect of the invention the opening has four sides, the lip extends about the four sides opening and the liner is mated to the container on the four sides. In a further additional feature of that aspect of the invention the liner has a rectangular base and four sides extending from the base, each of the sides having an edge adjoining the base and a distal edge distant from the base. The chamber has an opening defined between the distal edges of the sides.

In a still further additional feature of that aspect of the invention one of the sides has a lid member extending therefrom, the lid member being moveable to close the opening of the liner. In yet another additional feature of that aspect of the invention the lid member is a flap formed integrally with the liner, the flap having four lid edges, one edge being a folded hinge edge adjoining one of the distal edges of the sides, the remaining three lid edges having a closure for mating with the remaining three distal edges.

In another aspect of the invention there is a removable liner for placement inside the container. The liner is formed from a water impermeable plastic sheet. The sheet has a periphery. The liner has a quadrilateral base and four sides extending from the base to define a chamber therebetween capable of holding water. Each of the sides are joined to the base at a base edge. Each of the sides has a pair of lateral edges each meeting the base edge at a corner. Each of the sides has an edge opposed to the base edge and meets each of the lateral edges at a corner. The sheet has corner portions defined between adjacent lateral edges of two of the sides and the periphery and the corner positions are folded to lie against the sides.

In a further additional feature of that aspect of the invention the base is a rectangle and two of the sides, joined to the base on opposite sides of the rectangle, are trapezoidal. In a still further additional feature of that aspect of the invention the chamber has the shape of an inverted, truncated rectangular based pyramid. In yet another additional feature of that aspect of the invention the container has an internal face made from a reflective material and the liner is transparent.

In another aspect of the invention there is a soft sided insulated container, and a removable liner for placement inside the container. The liner is formed from a water impermeable plastic sheet. The sheet has a periphery. The liner has a rectangular base and four sides extending from the base to form a chamber therebetween, each of the sides being joined to the base at a base edge. The sheet is folded on a first pair of parallel fold lines to define one pair of the base edges. The sheet is folded on a second pair of fold lines to define the remainder of the edges. The sheet has four corner portions each defined between an end portion of one of the first pair of fold lines, an adjacent end portion of one of the second pair of fold lines and the periphery, and the corner portions are folded to lie against the sides.

In an additional feature of that aspect of the invention the sides have an inside face and an outside face and the corner portions are folded to lie against the outside faces. In another additional feature of that aspect of the invention each of the corners is folded to form a triangular flap, and each of the flaps is folded to lie against one of the sides. In still another additional feature of that aspect of the invention one of the triangular flaps is folded to lie against each of the sides of the liner. In still yet another additional feature of that aspect of the invention two of the triangular flaps are folded to lie against one side of the liner. In a further additional feature of that aspect of the invention two of the triangular flaps are folded to lie against one side of the liner, and the other two triangular flaps are folded to lie against another side of the liner.

In still a further additional feature of that aspect of the invention each of the sides has a distal edge opposed to its respective base edge. The chamber has a lip defined by the distal edges. The corner portions are fastened to the sides adjacent the lip. In still yet a further additional feature of that aspect of the invention one of the sides has a cover flap formed integrally therewith, and joined thereto at a cover fold, the cover flap mating with the distal edges of the remaining sides of the liner. In an additional feature of that aspect of the invention the container has a reflective inner surface and the liner is transparent.

In another aspect of the invention, there is a soft sided, collapsible, insulated container assembly. It has a first collapsible insulated container portion, a second collapsible container portion and a common wall shared between said first and second container portions. The first container portion has an insulated wall structure and a first chamber defined therewithin. The second container portion having an insulated wall structure and a second chamber defined therewithin. The common wall segregates the first and second chambers from each other. The first chamber is maintainable at a different environmental condition from the environmental condition of the second chamber.

In an additional feature of that aspect of the invention, one of the insulated container portions has a liner for containing liquids mounted within its respective chamber. In another additional feature, both of the insulated container portions have liners for containing liquids therein. In a further additional feature, the liner has a lowest extremity and an upper lip, and the liner is seamless to a depth of at least half the height from the lowest extremity to the upper lip. In a further additional feature, the liner is removable from its respective chamber. In a still further additional feature, the container has a partition member mounted within the liner. In an additional feature of that additional feature, the partition member includes a stiffening element. In another additional feature of that additional feature, the partition includes a thermally insulative layer for discouraging heat transfer through the partition. In still another additional feature, the liner has a fitting for engaging the partition, and the partition is movable to a plurality of positions in engagement with the fitting. In still yet another additional feature, the respective chamber has a plan form section, the partition is moveable to lie in a horizontal orientation relative to the chamber, and, in that horizontal position, the partition has a shape to match the plan form section.

In a further aspect of the invention, there is a soft sided collapsible container assembly. It includes a collapsible insulated wall structure having a chamber defined therewithin. A removable liner is provided for discouraging leakage of liquid from within the chamber. The liner has a lowest extremity and a lip. The liner is seamless to a height a least half way from the lowest extremity to the lip. There is a segregation member for dividing the chamber into at least two sub-compartments.

In an additional feature of that aspect of the invention, the segregation member is movable between a plurality of positions within the liner. In another additional feature, the segregation member is movable to at least one substantially vertical position for dividing the chamber into sub-compartments lying horizontally adjacent to the segregation member. In a further additional feature, the segregation member is movable to at least one substantially horizontal position for dividing the chamber into sub-compartments lying above and below the segregation member. In another additional feature, the partition member includes a stiffening element. I still another additional feature, the partition member includes a thermally insulative layer for discouraging heat transfer through the partition member.

BRIEF DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION OF A BEST MODE FOR PRACTICING THE INVENTION

Figure 1:
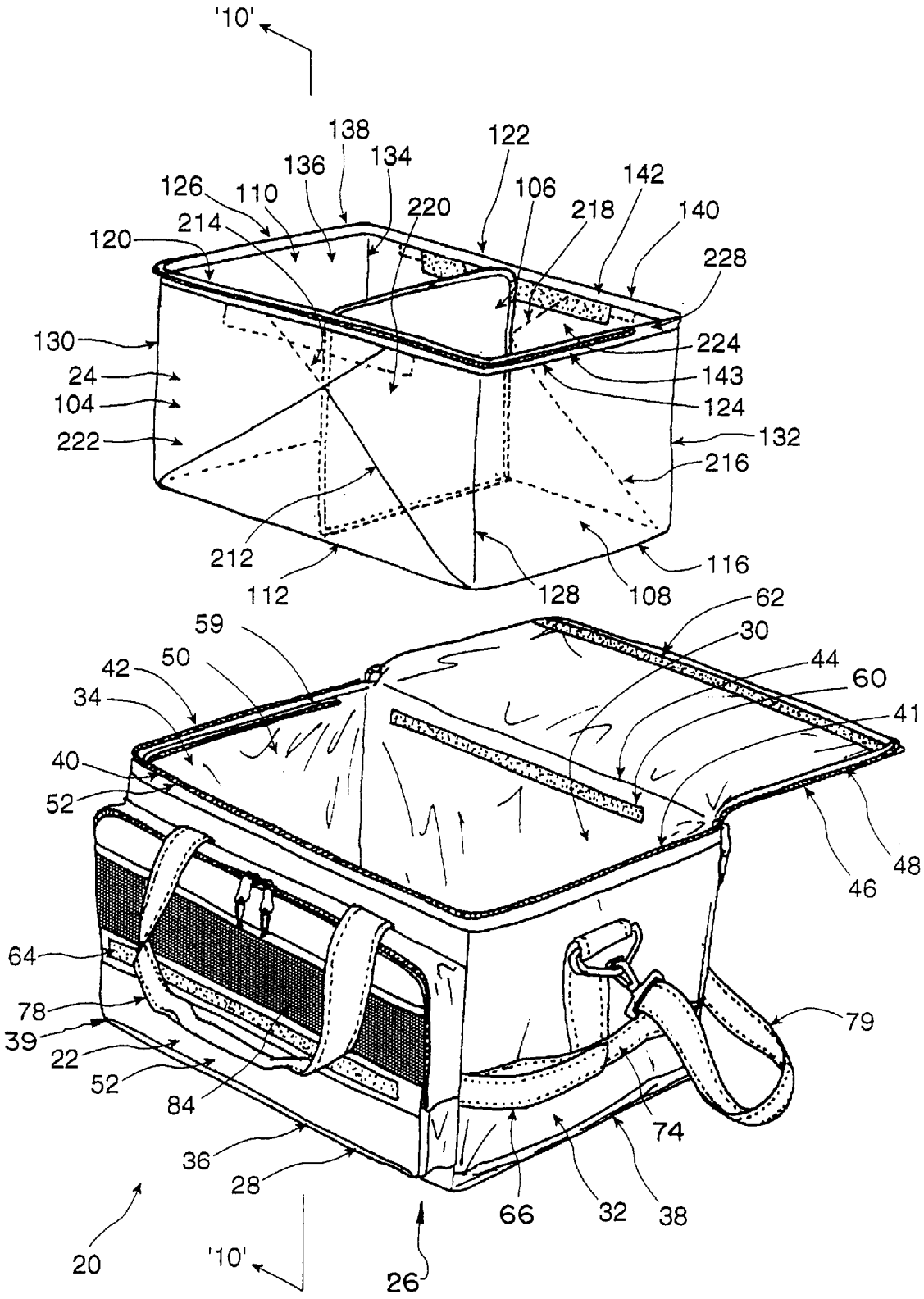
FIG. 1 is a three quarter view, general arrangement drawing of an insulated container and liner assembly according to the present invention.

The description which follows, and the embodiments described therein, are provided by way of illustration of an example of a particular embodiment, or examples of particular embodiments, of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

Figure 2:
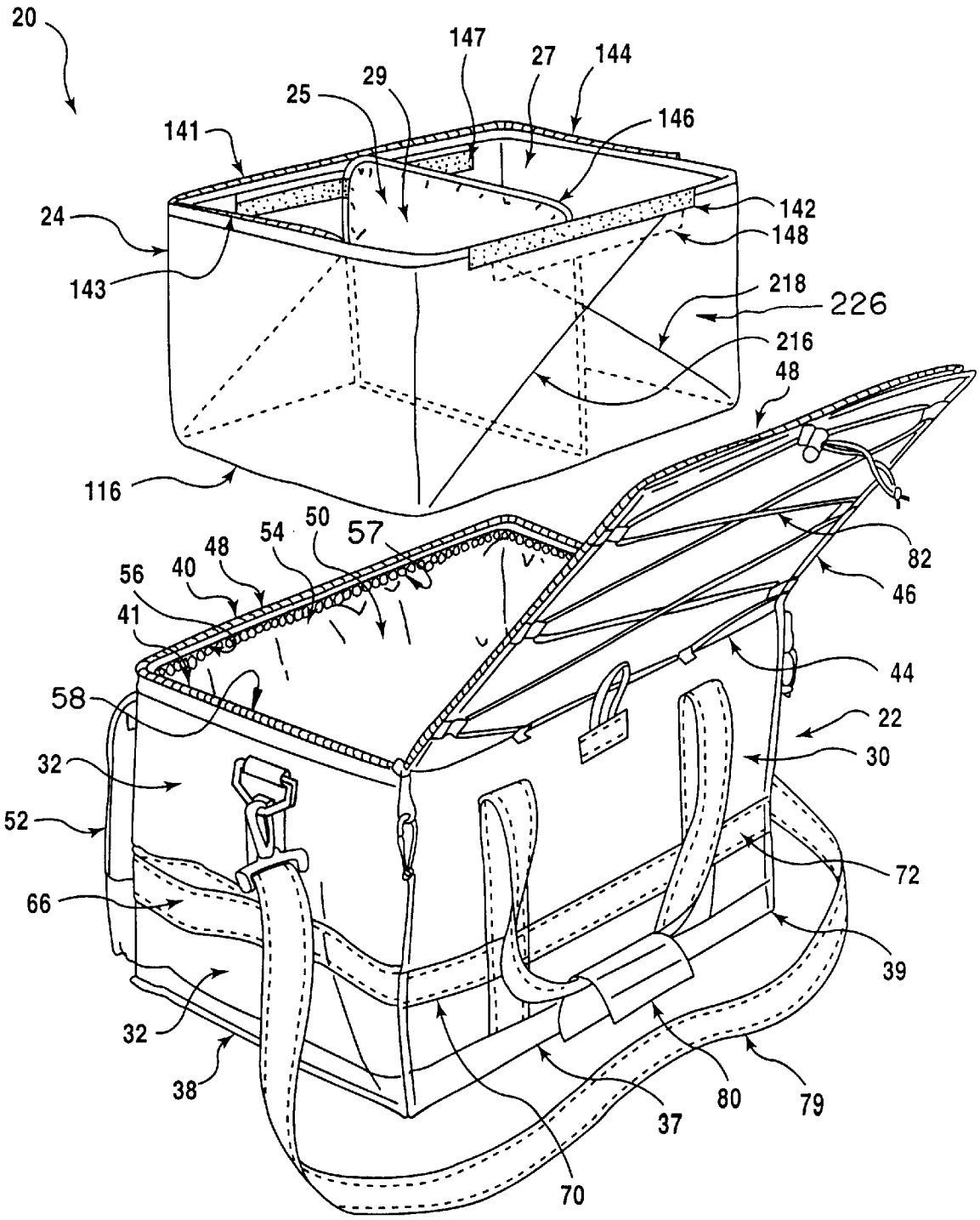
FIG. 2 is a view of the assembly of FIG. 1 taken on an opposite angle.

Referring to the general arrangement illustrations of FIGS. 1 and 2, an example of a preferred embodiment of an insulated container and liner assembly according to the principles of the present invention is indicated generally as 20. It has two major elements, those being an outer casing in the nature of a soft-sided insulated container 22, and a removable, impermeable liner 24 for placement inside container 22. An optional moveable bulkhead, or baffle, in the nature of a partition wall 25 seats within liner 24 for dividing the interior space into two sub-compartments 27, 29.

Looking at these major elements in detail, it can be seen that container 22 has a bottom 26, a front panel 28, a rear panel 30, and a pair of left and right hand side panels 32 and 34. In this preferred embodiment the choice of front and rear, left and right, orientations is arbitrary. Each of front panel 28, rear panel 30, and left and right hand side panels 32 and 34 is joined at sewn seams to bottom 26 at bottom vertices 36, 37, 38, or 39 respectively. Similarly, front panel 28 and side panels 32 and 34 have top edges 40, 41 and 42, distant from their base edges. Rear panel 30 is joined by a folded hinge 44 at its top edge to a top panel in the nature of a lid 46. Lid 46 has a closure member in the nature of a zipper 48 extending in a U-shape around the three free edge portions of its periphery to mate with the other portions of zipper 48 positioned about the three top edges 40, 41 and 42 of panels 28, 32 and 34. Lid 46 is moveable between a closed position, in which zipper 48 may be zipped closed, and an open position in which lid 46 is folded back to permit entry and exit of objects to and from an internal cavity 50 defined between bottom 26 and panels 28, 30, 32 and 34. A generally rectangular insulated auxiliary pouch 52 is mounted to the front face of front panel 28.

In the preferred embodiment, lid 46 has an extent substantially equal to that of bottom panel 26. This need not be the case. Lid 26 could be a small opening set in a larger top panel, or could be an opening of half, or some other portion of the panel. The opening need not extend fully along three sides of lid 26, but could extend along part of one or two sides as may be found suitable in a particular use.

Top edges 40, 41, and 42 form the rim 54 of cavity 50. On the inside of rim 54 is a liner securing means, or liner attachment mounting, in the nature of a zipper 56, which, in the embodiment illustrated, includes portions 57, 58, and 59 mounted respectively to panels 28, 32, and 34 near their upper margins, and a hook and eye fabric fastener strip 60 mounted to panel 30. Although this arrangement is preferred, in an alternative embodiment all of strip portions 57, 58, 59 and 60 (or some other combination of them) could be hook-and-eye fabric fasteners. Other types of mounting could be used, in addition to zippers, such as interlocking seal strips, snaps, clips, grommets or other means.

Container 22, with liner 24 installed, can be folded to a collapsed position, as shown in FIGS. 1, 7, 8 and 9. In this collapsed, or storage position, side panels 32 and 34 fold inward, and bottom 26 folds upward. This permits front panel 28 to move toward rear panel 30. Lid 46 is then drawn forward and downward in front of front panel 28 and auxiliary pouch 52. Lid 46 has, on its inner face, spaced inwardly from zipper 48, a retainer in the nature of another hook and eye fastener strip 62 that engages a mating hook and eye fastener strip 64 located on a lower portion of the front face of auxiliary pouch 52. In addition, left and right hand side retainers 66 and 68 mounted to the left and right hand edges of auxiliary pouch 52 of front panel 28 are drawn around to fasten to fastening strips 70 and 72 located on the outer, rearward face of rear panel 30. (When container 22 is in its open position, strips 66 and 68 engage storage side retainers 74 and 76 located on side panels 32 and 34 respectively).

Other features of container 22 are visible in FIGS. 1 and 2. Front and rear carrying handles 78 and 80 with reinforced bails are attached to both front panel 28 and rear panel 30 to permit two people to carry assembly 20 between them. In the preferred embodiment assembly 20 has a maximum capacity of 24 quarts. Smaller embodiments, include a twelve quart container. A single shoulder strap 79 is attached to side panels 32 and 34. An elasticized retaining matrix 82 permits other materials, such as cups, plates, serving utensils or other objects to be carried on top of assembly 20. Above strip 64, auxiliary pouch 52 has a see-through mesh pocket 84, such as may be convenient for carrying knives, forks, spoons or other objects.

Figure 10:
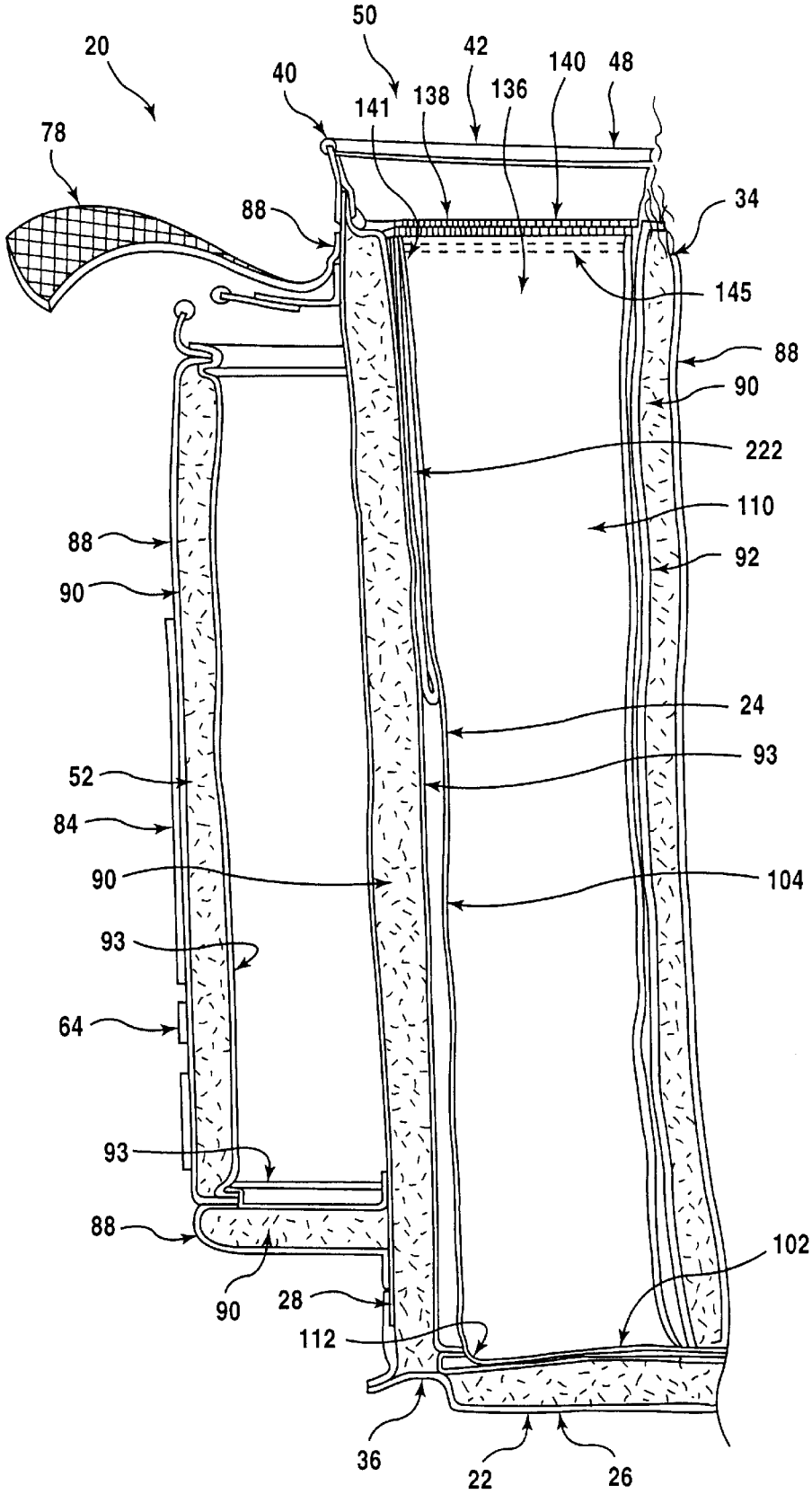
FIG. 10 shows the construction of a wall section of the assembly of FIG. 1.

FIG. 10 shows a cross section of front panel 28 with liner 24 in place. A scab section of panel 34 is also shown to reveal its layers of construction. With the exception of auxiliary pouch 52, this section is typical not only of front panel 28 but also, generally, of rear panel 30, side panels 32 and 34, bottom 26 and lid 46. The outer facing layer of front panel 28 is a canvas covering layer 88 for resisting abrasion. It overlays a closed cell foam insulation layer 90. The inner face of insulation layer 90 is covered by flexible plasticised metallic foil sheeting 92 that is shiny and reflective. The material is sold under the name Therma-Flect (T.M.). Liner 24 lies inside sheeting 92, and is pressed against it by the objects it contains. The inside of pouch 52 is lined with white vinyl sheeting, 93 on its forward and bottom sides.

Figure 3:
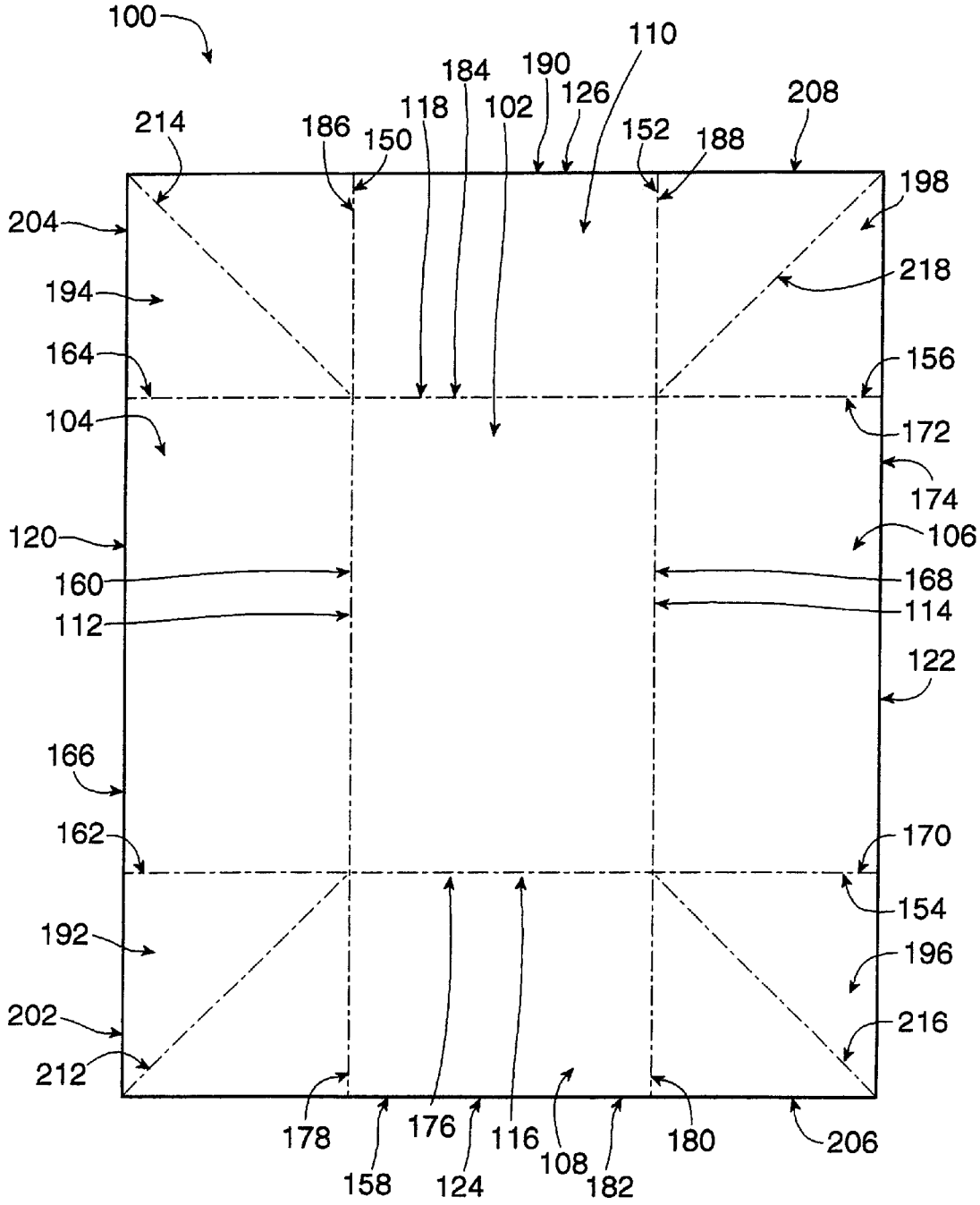
FIG. 3 is a developed view of a liner for use in the assembly of FIG. 1.

Liner 24 is shown in FIGS. 1, 2 and 3. It is made from a membrane, or web, in the nature of a sheet 100 of flexible, transparent plastic stock, in particular, static cling vinyl. The shiny, reflective surface of sheeting 92 is visible through liner 24 in use. Liner 24 has a base 102 and four sides, front, rear, left hand and right hand respectively, 104, 106, 108, and 110 extending upwardly from base 102. Each of sides 104, 106, 108 and 110 is joined to base 102 at a base edge, 112, 114, 116 or 118, as indicated, and each has an opposite, distal edge 120, 122, 124 or 126 distant from its respective base edge. The sides meet at respective upstanding corners 128, 130, 132 and 134. A chamber 136 is defined between base 102 and sides 104, 106, 108 and 110. Chamber 136 has an opening 138 defined by the peripheral lip 140 formed collectively by the distal edges 120, 122, 124 and 126 of sides 104, 106, 108 and 110. Immediately below lip 140 liner support fasteners, in the nature of hook and eye strips, are mounted to sheet 100. This mounting may be by heat welding or by use of a bonding agent or adhesive. In the preferred embodiment lip 140 is folded over to form a hem, and fasteners 141, 144, 143 are of the nature of a continuous zipper around three sides of lip 140, and a fastener 142 in the nature of a fabric hook-and-eye strip are sewn in place with stitching 145 that is at a height relative to base 102 that is expected to be well above the liquid level in liner 24.

In an alternate embodiment, fasteners 141, 142, and 143 are all fabric hook and eye fasteners each mounted on one side of lip 140, and which mate with corresponding hook-and-eye fastener strips mounted to container 22. These fastener strips are commonly sold under the name Velcro (T.M.). Optional partition 25 is variably positionable. About the upper portion of its periphery it has a strip engaging material 146 that catches on mating strips 147 and 148 located on the inner face of liner 24. These strips can be hook and eye fastener strips. The range of the strips permits the division of sub compartments 27 and 29 of chamber 136 into equal, half- and half portions, or into some other portions, such as ¼ to ¾, ⅓ to ⅔, ⅖ to ⅗ and so forth as may be found desirable given the objects to be contained in chamber 136.

In FIG. 3 sheet 100 is shown in developed view, as it would be before being folded to form liner 24. A first pair of parallel fold lines 150 and 152 extend across sheet 100, and a second pair of parallel fold lines 154 and 156, perpendicular to lines 150 and 152 extend along sheet 100, thus dividing it into nine portions within the rectangular periphery, 158, of sheet 100. It will also be noted that each of lines 150, 152, 154 and 156 has two intersections, and is thus divided into a central sector between the parallel lines it intersects, and a pair of end sectors between each of the parallel lines it intersects and the line's termination at periphery 158.

The central portion of sheet 100, bounded by the central sector of each of lines 150, 152, 154 and 156, defines base 102, each of those sectors defining one of base edges 112, 114, 116 and 118. Front side 104 is defined between the central sector 160 of line 150, two parallel forward end sectors 162 and 164 of lines 154 and 156, and a mid-edge sector 166 of periphery 158. Rear side 106 is defined by the central sector 168 of line 152, two parallel rearward end sectors 170 and 172 of lines 154 and 156, and a mid edge sector 174 of periphery 158. Left hand side 108 is defined by central sector 176 of line 154, two left end sectors 178 and 180 of lines 150 and 152, and a mid-edge sector 182 of periphery 158. Right hand side 110 is defined by central sector 184 of line 156, two right end sectors 186 and 188 of lines 150 and 152, and a mid-edge sector 190 of periphery 158.

The remaining four portions of sheet 100 are corner portions 192, 194, 196 and 198 defined by a pair of adjacent end sectors of a pair of perpendicular lines, and a corner sector of periphery 158, indicated respectively as 202, 204, 206 and 208. Corner portions 192, 194, 196 and 198 are bisected by diagonal bisectors 212, 214, 216 and 218 which extend from the intersection of the respective perpendicular lines to periphery 158.

Having thus defined the geometry of sheet 100, liner 24 is formed by folding sides 104, 106, 108 and 110 upwardly such that sectors 162 and 178, 164 and 186, 170 and 180, and 172 and 188 lie adjacent to each other to form corners 128, 130, 132 and 134 respectively. This folding necessitates folding of corner portions 192, 194, 196 and 198, and this is done along their respective diagonal bisectors.

When folded along bisectors 212, 214, 216, and 218 corner portions 192, 194, 196 and 198 form triangular flaps 220, 222, 224 and 226 as shown in FIGS. 1 and 2. In the preferred embodiment flaps 220 and 222 are folded to lie against the outside face of front side 104, the corner of flap 220 lying most distant from corner 128 overlapping the corner of flap 222 lying most distant from corner 130. Similarly flaps 224 and 226 are folded to lie against the outside face of rear side 106 the most distant corner of flap 224 overlapping the most distant corner of flap 226. One edge of each flap lies roughly flush with lip 140, which is folded over and the entire periphery of opening 138 of chamber 136 sewn as a hem 228 having a double row of stitches. In this way liner 24 is formed from sheet 100 such that it is not only free of welded seams, but free of any seams below hem 228 of lip 140.

In the preferred embodiment the folding process is purely mechanical, and can be performed relatively quickly, in contradistinction to heat welding or adhesive bonding processes which requires a time interval for heating and cooling or for adhesive curing. Inasmuch as the preferred embodiment uses a relatively thick static cling vinyl, sheet 100 can be folded over a cube form of the desired dimensions, and held in place by its own clinging properties in preparation for the sewing of hem 228.

The overlap of the tips of flaps 220 and 222, and flaps 224 and 226, and subsequent sewing makes it doubly improbable that liner 24 will unfold.

Liner 24 is formed from a single integral sheet, and, absent punctures of that sheet, is not intended to leak below the level of the sewn seam at lip 140. The body of base 102 and sides 104, 106, 108 and 110 is seamless, being free of heat welds or other joints. In general use the liquid level in chamber 136 is not expected to be greater than one half of the height of the sides, and still less commonly to be more than three quarters of the height. There are no seams below either of these levels, heat welded or otherwise.

Figure 7:
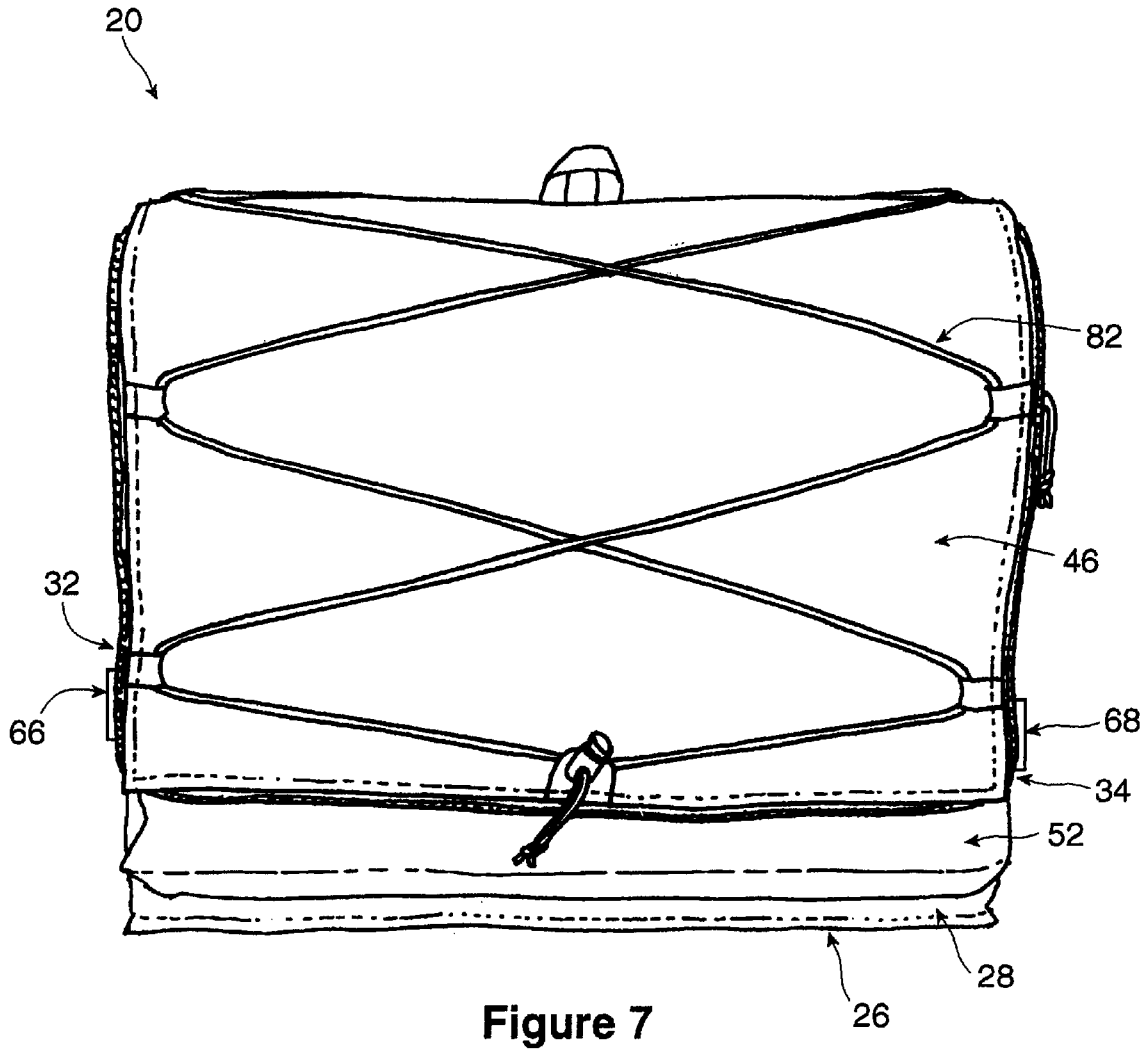
FIG. 7 is a front view of the assembly of FIG. 1 in a collapsed position.
Figure 8:
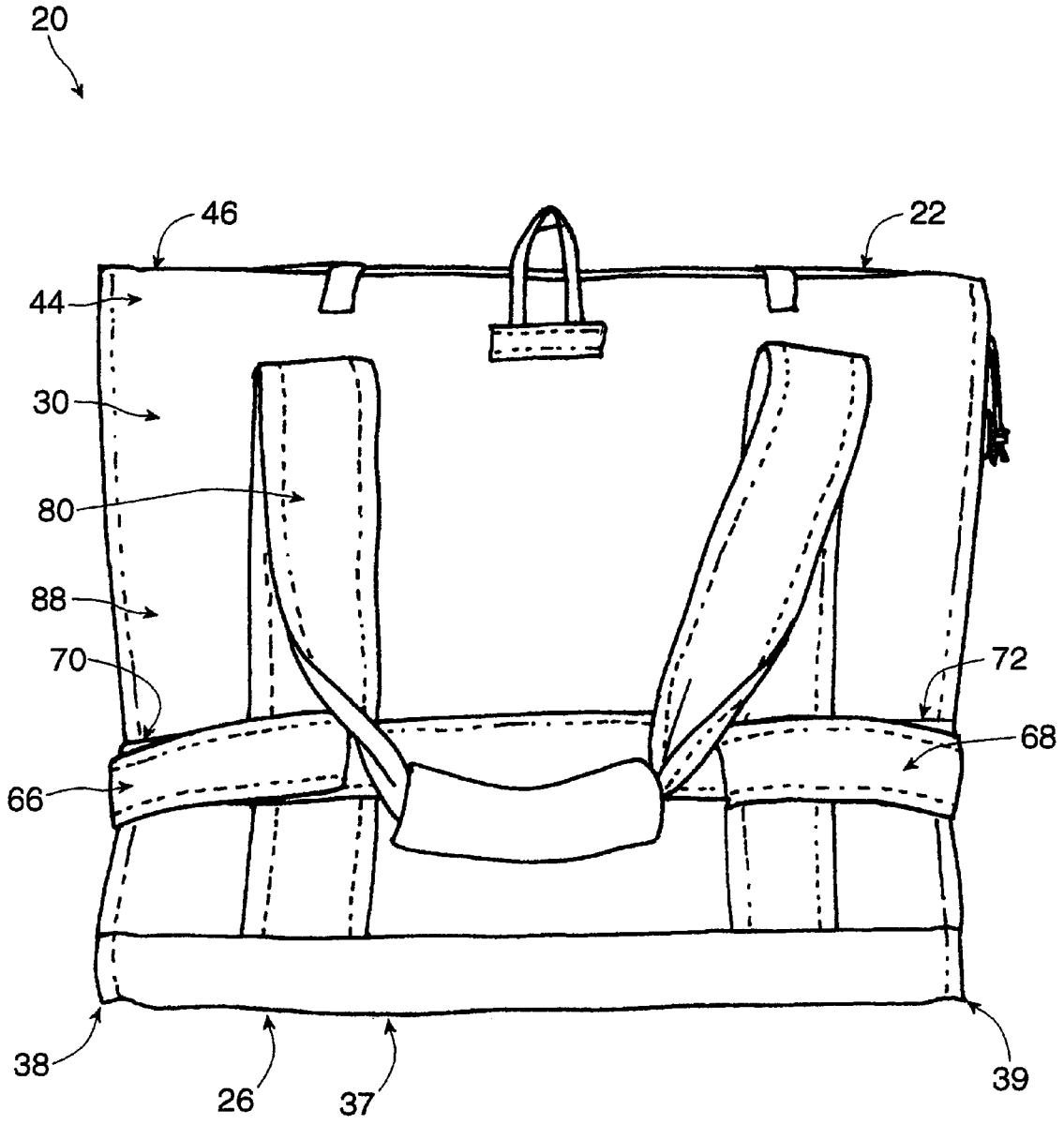
FIG. 8 is a rear view of the assembly of FIG. 1 in a collapsed position.
Figure 9:
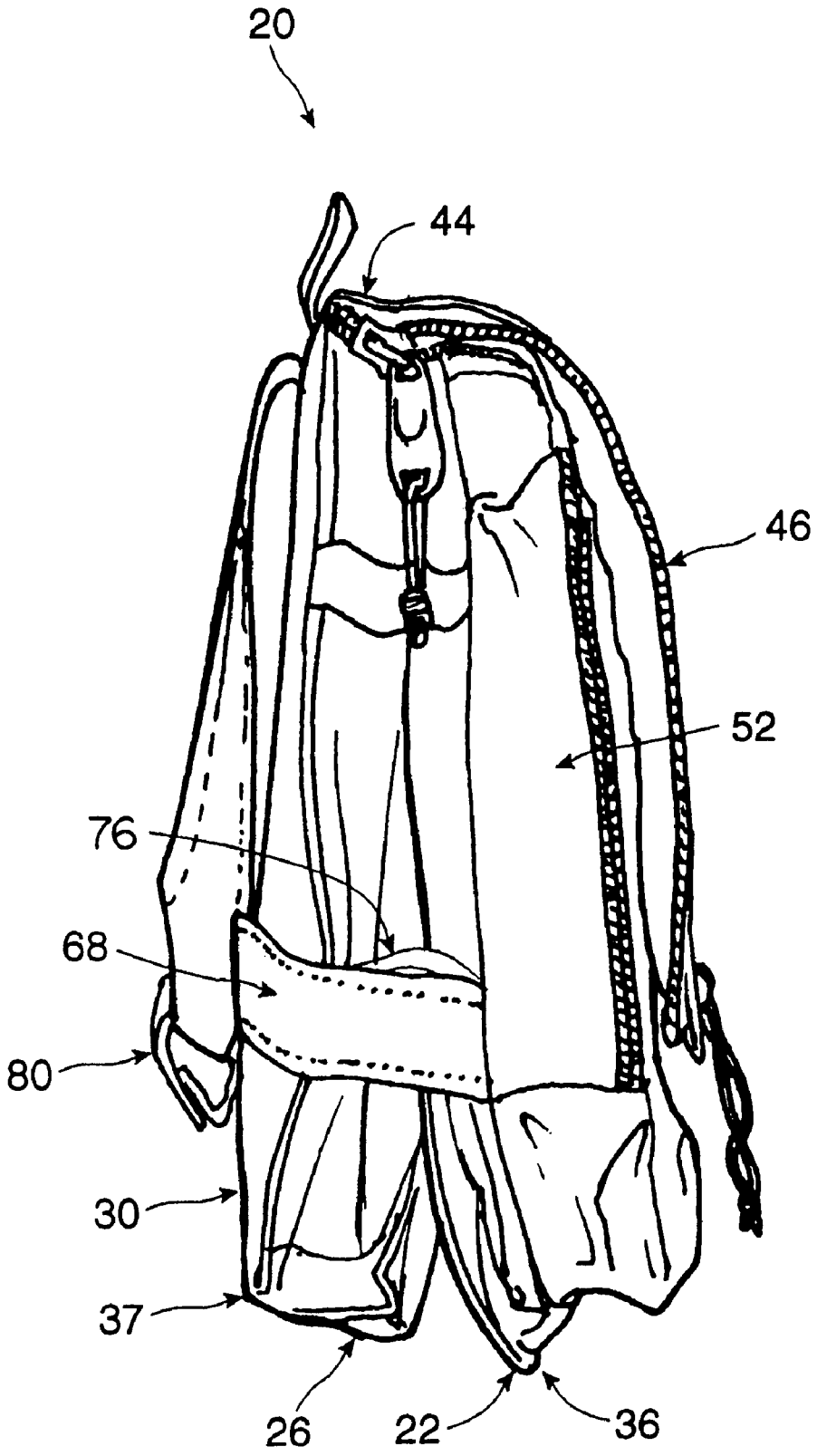
FIG. 9 is a side view of the assembly of FIG. 1 in a collapsed position.

Liner 24 is also thin enough that it can be folded inside container 22 when container 22 is compressed to its collapsed position as illustrated in FIGS. 7, 8, and 9. Liner 24 need not be transparent, but could be translucent or opaque. A transparent liner is preferred since it permits the reflection of sheeting 92 to be seen.

Figure 11:
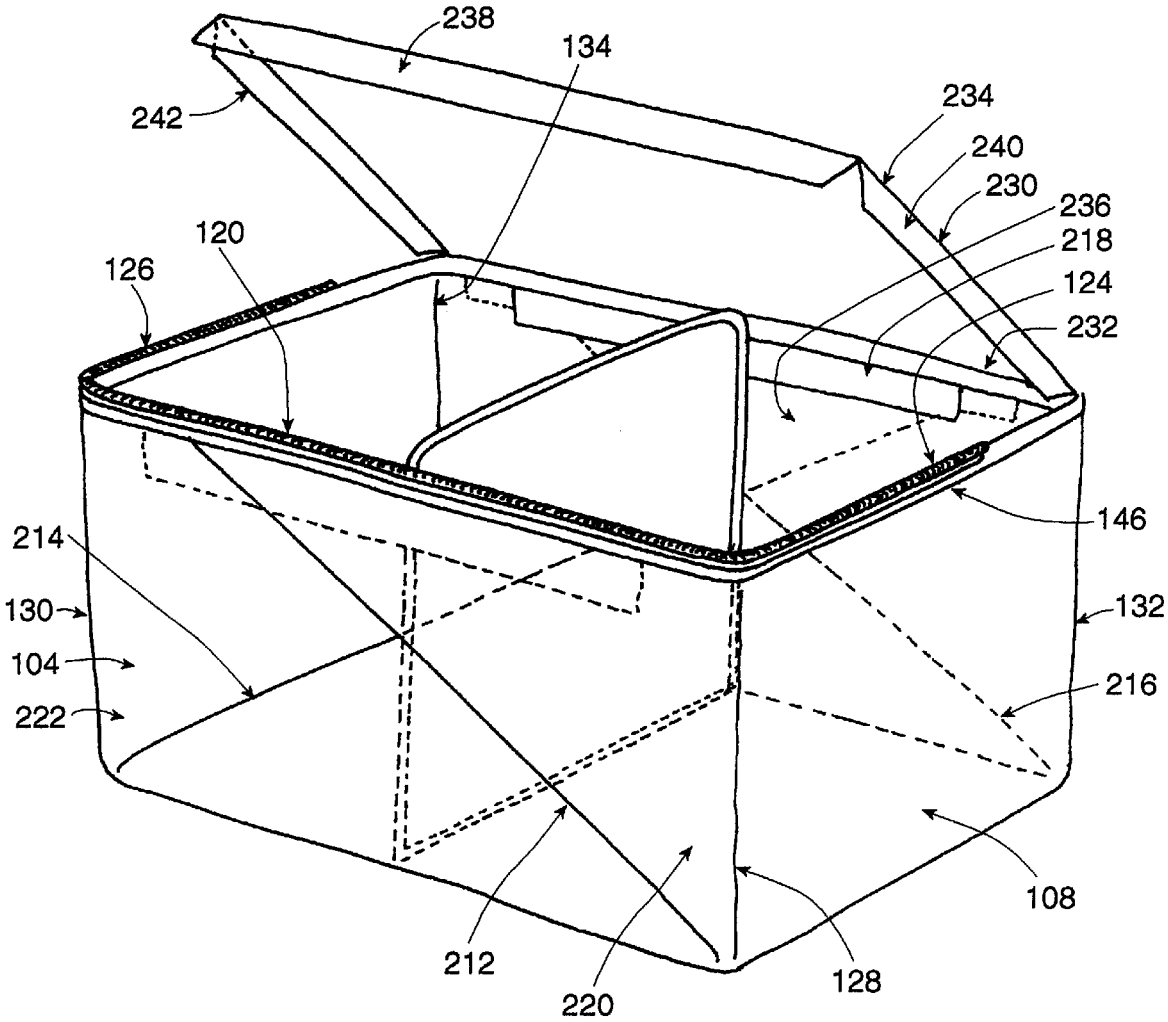
FIG. 11 is a view of an alternative liner for the assembly of FIG. 1.

In an optional embodiment, a liner 224 can have its own closure, or lid, 230, to provide a double closure with lid 46 of container 22 in FIG. 11. As shown in FIG. 11, optional lid 230 extends on a folding plastic hinge 232 that is an integral part of sheet 234 from rear side 236 of sheet 234, and mates at front, left hand and right hand side edges 238, 240 and 242 along a U-shaped closure interface such as may be held closed by a closure member in the nature of a seal, a zipper, a hook and eye fabric fastener, or a similar device. It is not necessary that the opening of the container, or the liner, form a parallel plane to the respective base or bottom sides. The opening could be in a skewed plane, or could be something other than a plane.

In alternative embodiments, one of each of corner flaps 220, 222, 224 and 226 can be folded against each of sides 104,106, 108 and 110, or a pair (220, 224) can be folded against left hand side 108 and another pair (222, 226) against right hand side 110, rather than against front and rear sides 104 and 106 as illustrated in FIG. 11. It is not necessary that the corner portions have one edge lying flush with lip 146. However, if the corner portions are cut down, the height at which a liquid tight barrier is provided may not necessarily be as high as shown in the preferred embodiment of FIG. 1. It is also not necessary that corner portions 192, 194, 196, and 198 be folded against the outside faces of the sides, but could be folded to lie along the inside faces. It would also be possible to fold each flap to lie partially against one side and partially against another side by using more than one fold line and by cutting the periphery of the corner portions differently. There is simplicity in using a single fold and to fold the flaps against the outside of one side of the liner, as shown in the preferred embodiment of FIG. 1.

Figure 4:
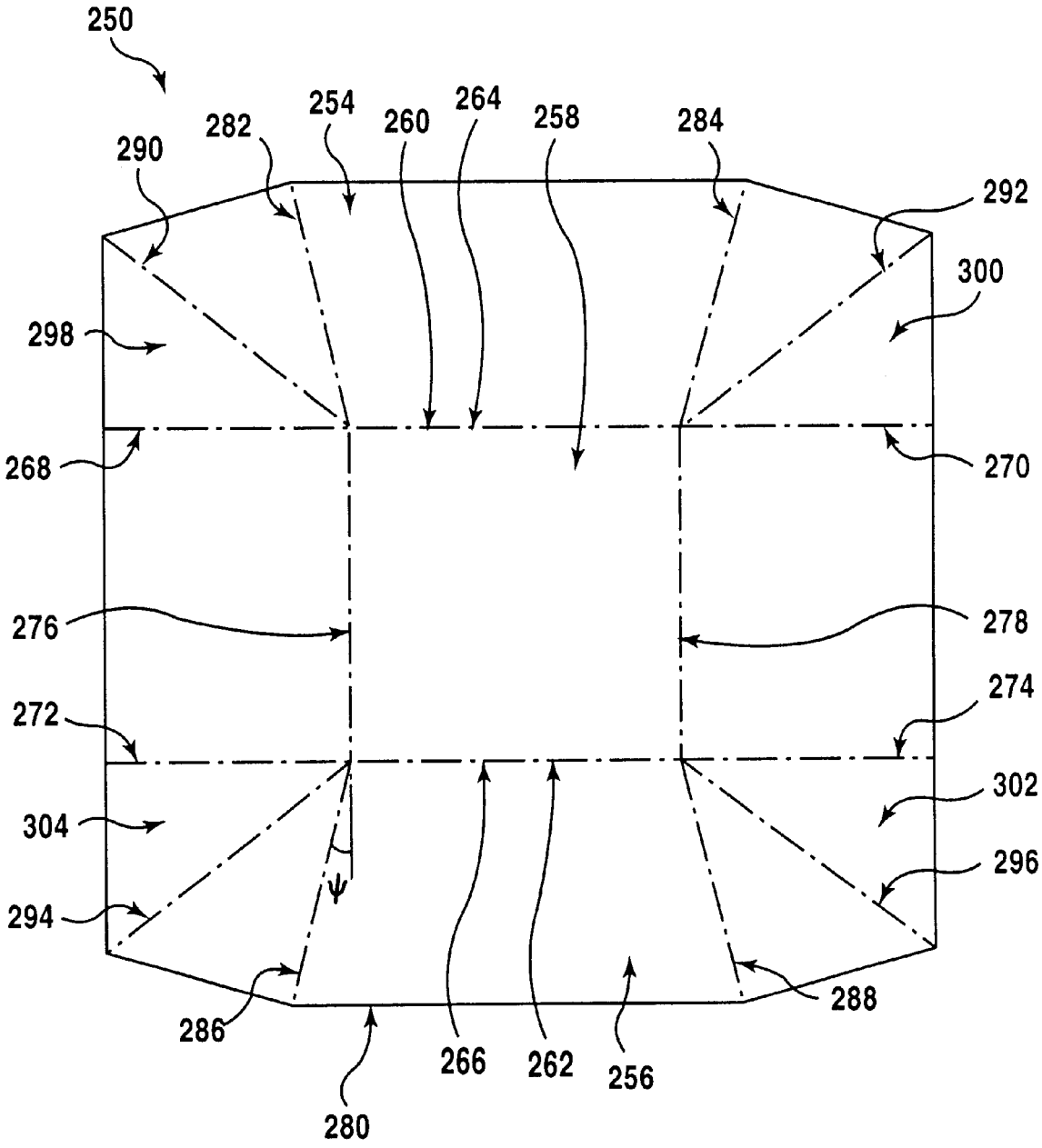
FIG. 4 is a developed view of an alternative liner for an assembly analogous to the assembly of FIG. 1 in which two sides are tapered.
Figure 5:
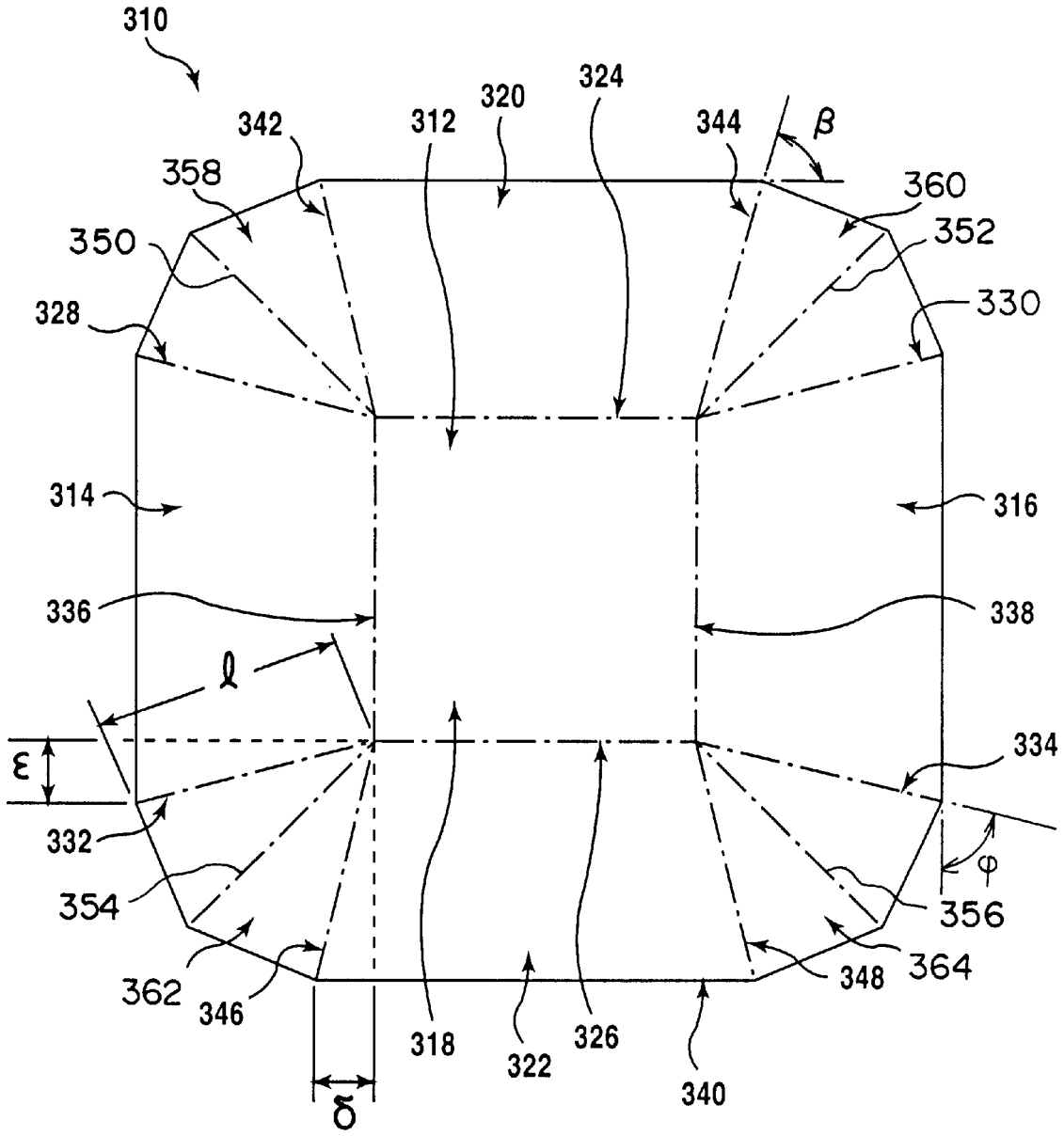
FIG. 5 is a developed view of an alternative liner for an assembly analogous to the assembly of FIG. 1 in which four sides are tapered.
Figure 6:
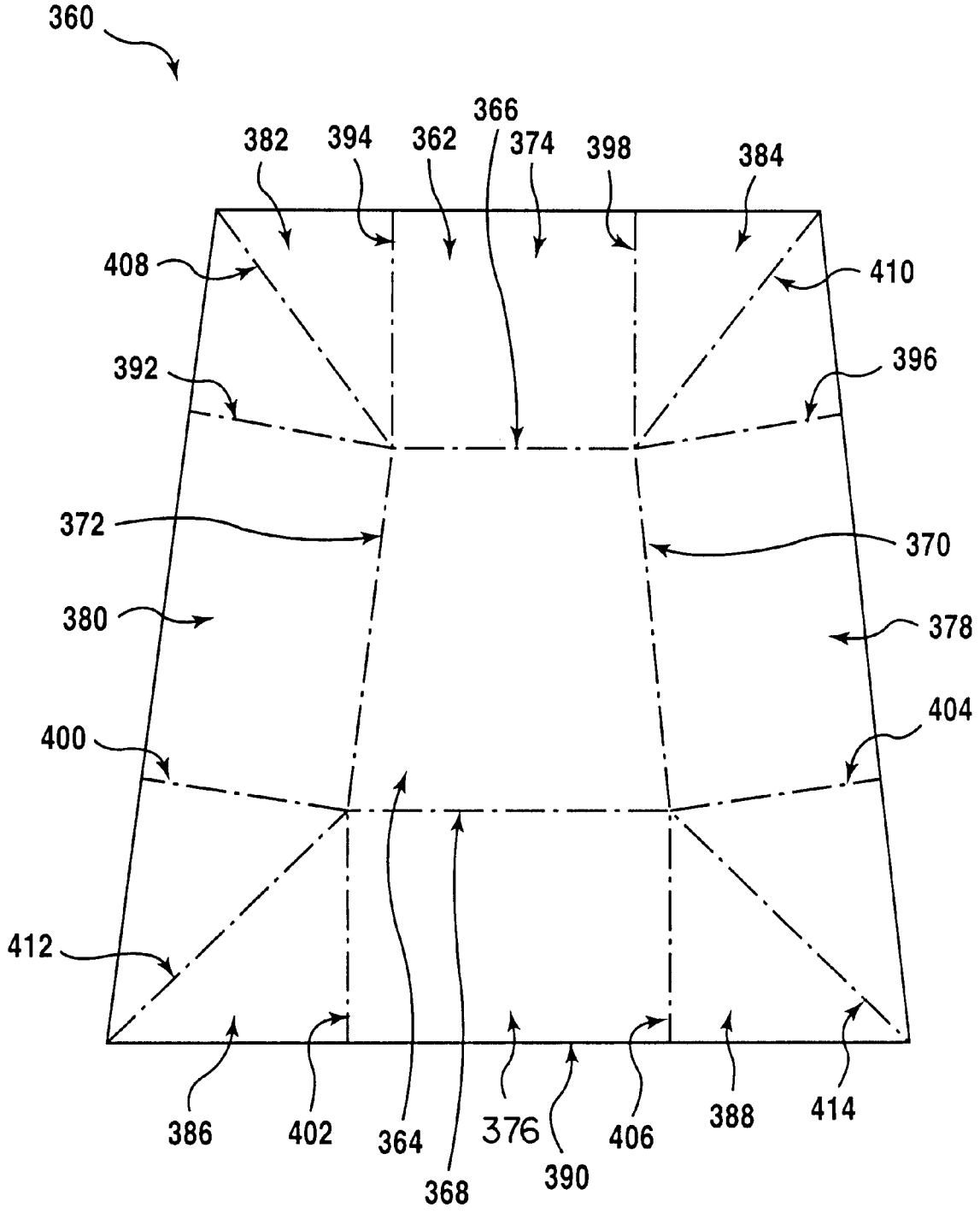
FIG. 6 is a developed view of an alternative liner for an assembly analogous to the assembly of FIG. 1 in which the forward side of the assembly is wider than the rearward side.

As shown in the developed views of the alternate embodiments of FIGS. 4, 5, and 6, the liner need not be a cube or cuboid, but could be a tapered, trapezoidal, or truncated pyramidal shape. In the embodiment of FIG. 4 a developed sheet 250 has fold lines for forming a liner having a pair of opposed trapezoidal sides 254 and 256 which rise at right angles from a base 258, and a pair of opposed rectangular sides that are folded upward at an angle corresponding to the rake angle $\psi$ of trapezoidal sides 254 and 256. It can be seen that there is one pair of parallel fold lines 260 and 262, each line having a central sector 264, 266 and a pair of left and right end sectors 268, 270 or 272, 274. There is also a pair of fold line sectors 276 and 278 which define the remaining two sides of base 258 (perpendicular to sectors 264 and 266). The intersections of sectors 276, 264, 278, and 266 define the corners of base 258. Extending away from those corners to periphery 280 are left and right hand canted trapezoidal side sectors 282, 284, 286, and 288 to define the remaining vertices of trapezoidal sides 254 and 256. At the angular bisector of the included angle between adjacent pairs of rectangular side lateral sectors and trapezoidal side sectors, as, for example between sectors 268 and 282, are corner portion fold lines 290, 292, 294, and 296. Corner portions 298, 300, 302 and 304, each defined between one trapezoidal side end sector, one rectangular side end sector and periphery 280, have been trimmed along periphery 280 to lie flush with the resulting lip. When sheet 250 is folded in a manner analogous to the folding of sheet 100, a cradle shaped liner will result, for mating use with a similarly cradle shaped container analogous to container 22.

In the embodiment of FIG. 5 a developed sheet 310 has fold lines for forming a liner 312 having a first pair of opposed trapezoidal sides 314 and 316 which rise at a non-perpendicular angle $\phi$ from a base 318, and a second pair of opposed trapezoidal sides 320, 322 that are folded upward at a rake angle $\beta$ of the first pair of trapezoidal sides 314 and 316. It can be seen that there is one pair of fold line sectors 324, 326 pairs of left and right hand end sectors 328, 330 or 332, 334 pairs of left and right hand end sectors 328, 330 or 332, 334 and a perpendicular pair of fold line sectors 336 and 338 which define the remaining two sides of base 318. The intersections of sectors 336, 324, 338, and 326 define the corners of base 318. Extending away from those corners to periphery 340 are left and right hand trapezoidal side lateral sectors 328, 330, 332 and 334. Similarly, left and right hand canted trapezoidal side sectors 342, 344, 346, and 348 extend from those intersections toward periphery 340 to define the remaining vertices of the trapezoidal sides. At the angular bisector of the included angle between adjacent pairs of rectangular side lateral sectors and trapezoidal side sectors, as, for example between sectors 328 and 342, are corner portion fold lines 350, 352, 354, and 356 of corner portions 358, 360, 362 and 364.

Sectors 332, 334, 328, 330, 342, 344, 346 and 348 all have the same true length, indicated as l. The distance that sectors 332, 334, 336 and 338 are splayed outward from square is indicated as $\epsilon$. The distance that sections 342, 344, 346 and 348 are splayed outward from square is indicated as $\delta$. Angle $\phi$ satisfies the condition that $\text{Sin } \phi=[\epsilon/(l^2-\delta^2)^{1/2}]$. Similarly angle $\beta$ satisfies the condition that $\text{Sin } \beta=[\delta/(l^2-\epsilon^2)^{1/2}]$.

When folded in a manner analogous to the folding of sheet 100, sheet 310 will form a truncated, inverted rectangular shaped pyramid. It should be noted that the pairs of opposed slanted pyramid sides need not rise at the same angle, but could be at different angles. In the most general case, each side could rise at a different angle, and to a different height. The upper edges of the sides need not be level, but could have a slant, or, alternatively, need not be linear but could be curved as may suit the desired geometry. However, it is expected that the sides will, most often, have straight and level edges.

In the embodiment of FIG. 6, a developed sheet 360 has fold lines for forming a liner 362 having a trapezoidal base 364 such as might be desired in a knapsack having a large rearward face for placement against a person's back, and a narrower outer or forward face. A pair of parallel lines of unequal length, being a short front fold line 366 and a longer rear fold line 368, define the parallel sides of the trapezoidal base 364. A pair of left and right hand side fold lines 370 and 372 extend between lines 366 and 368 at angles to define the splayed sides of trapezoidal base 364. Front side 374, rear side 376, left side 378 and right side 380 are all hinged along respective fold lines 366, 368, 370 and 372 to base 364. Corner portions 382, 384, 386 and 388 are defined between the periphery 390 and respective pairs of side sectors 392 and 394, 396 and 398, 400 and 402, and 404 and 406. Each of portions 380, 382, 386, and 388 has a fold line 408, 410, 412 or 414 on which the respective corner portion is folded, those portions being trimmed along their peripheral edges to lie flush with the peripheral edges of the respective sides against which they are folded, similar to the manner described above in connection with the preferred embodiment.

Figure 12:
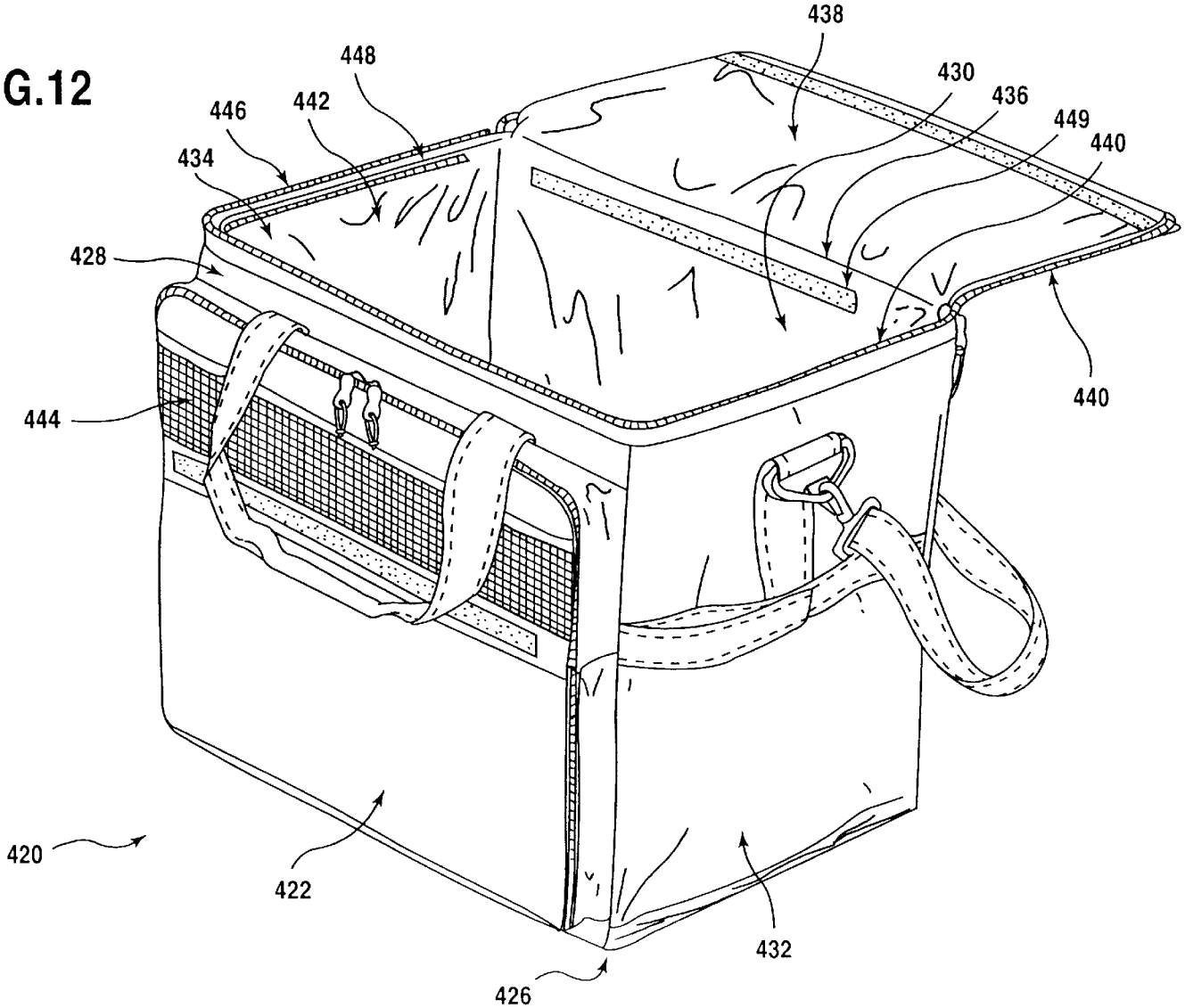
FIG. 12 is an isometric view of an alternative insulated container for an assembly similar to that of FIG. 1, but being of greater depth.
Figure 13:
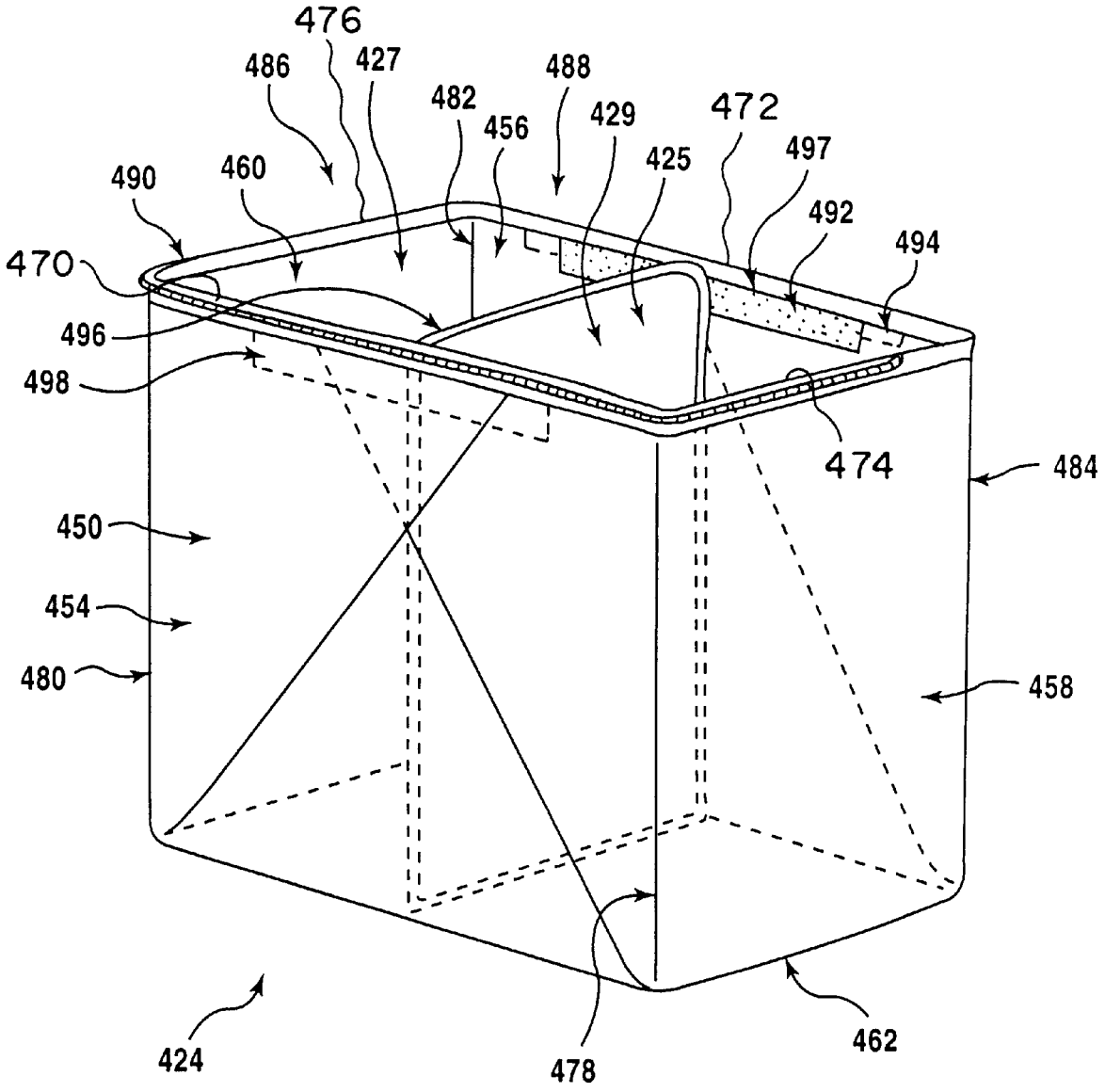
FIG. 13 shows a liner for the insulated container of FIG. 12 with an internal divider in a vertical orientation.

Referring to the general arrangement illustrations of FIGS. 12 and 13, an alternative embodiment of an insulated container and liner assembly is indicated generally as 420. It has two major elements, those being an outer casing in the nature of a soft-sided insulated container 422, and a removable, impermeable liner 424 for placement inside container 422. An optional moveable bulkhead, or baffle, in the nature of an insulated, partition wall 425 seats within liner 424 for dividing the interior space into two chambers, or sub-compartments 427, and 429.

Looking at these major elements in detail, it can be seen that container 422 is of generally similar construction to container 22. Container 422 has a bottom 426, a front panel 428, a rear panel 430, and a pair of left and right hand side panels 432 and 434. Each of front panel 428, rear panel 430, and left and right hand side panels 432 and 434 is joined at sewn seams to bottom 426 at bottom vertices. Rear panel 430 is joined by a folded hinge 436 at its top edge to a top panel in the nature of a lid 438. Lid 438 has a closure member in the nature of a zipper 440 extending in a U-shape around the three free edge portions of its periphery to mate with the other portions of zipper 440 positioned about the top edges of panels 428, 432 and 434. Lid 438 is moveable between a closed position, in which zipper 440 may be zipped closed, and an open position in which lid 438 is folded back to permit entry and exit of objects to and from an internal cavity 442 defined between bottom 426 and panels 428, 430, 432 and 434. A generally rectangular insulated auxiliary pouch 444 is mounted to the front face of front panel 428.

On the inside of rim 446 is a liner securing means, or liner attachment mounting, in the nature of a zipper 448, which includes portions mounted respectively to panels 428, 432, and 434 near their upper margins, and a hook and eye fabric fastener strip 449 mounted to panel 430. In an alternative embodiment the strip portions (or some other combination of them) could be hook-and-eye fabric fasteners. Other types of mounting could be used, in addition to zippers, such as interlocking seal strips, snaps, clips, grommets or other means.

Container 422, with liner 424 installed, can be folded to a collapsed position in a similar manner to that of container 22, as shown in FIGS. 7, 8 and 9 and described above. Container 422 also has the other feature of container 22 noted above such as shoulder straps, carrying handles, an elasticized retaining matrix, and a see-through mesh pocket. Aside from greater depth, container 422 has the same construction as container 22 described above with reference to FIG. 10.

Figure 14:
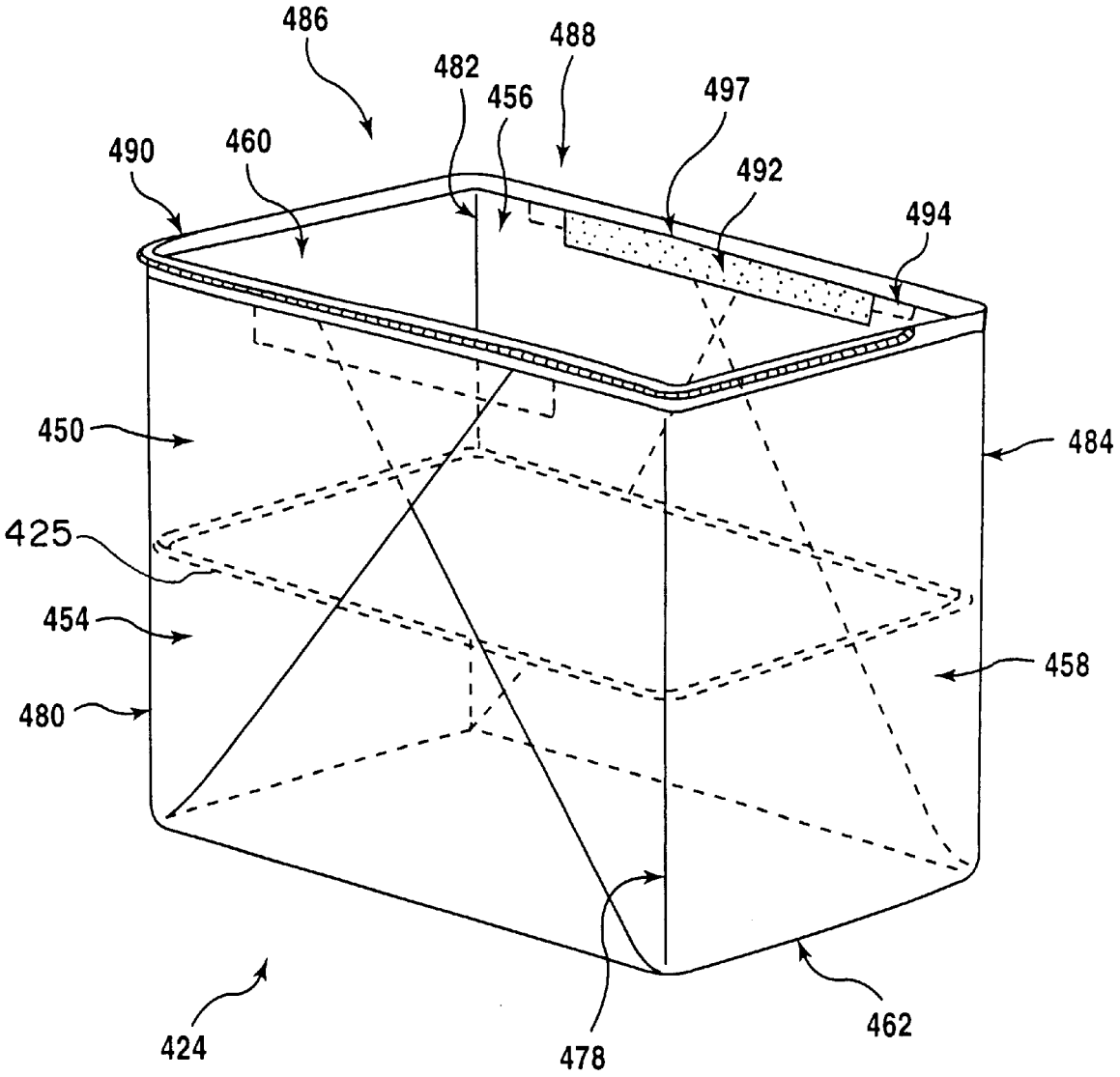
FIG. 14 shows a liner for the insulated container of FIG. 12 with an internal divider in a horizontal orientation.

Liner 424, is shown in FIGS. 13 and 14. It is made from a membrane, or web, in the nature of a sheet 450 of flexible, transparent plastic stock, in particular, static cling vinyl. Liner 424 has a base 462 and four sides, front, rear, left hand and right hand respectively, 454, 456, 458, and 460 extending upwardly from base 462. Each of sides 454, 456, 458 and 460 is joined to base 462 at a base edge, and each has an opposite, distal edge distant from its respective base edge. The sides meet at respective upstanding corners 478, 480, 482 and 484. A chamber 486 is defined between base 462 and sides 454, 456, 458 and 460. Chamber 486 has an opening 488 defined by the peripheral lip 490 formed collectively by the distal edges 470, 472, 474 and 476 of sides 454, 456, 458 and 460. Immediately below lip 490 liner support fasteners, in the nature of hook and eye strips, are mounted to sheet 450. This mounting may be by heat welding or by use of a bonding agent or adhesive. Lip 490 is folded over to form a hem, and a continuous zipper around three sides of lip 490, and a fastener 492 in the nature of a fabric hook-and-eye strip are sewn in place with stitching 494 that is at a height relative to base 462 that is expected to be well above the liquid level in liner 424. It will be appreciated that liner 424 could, alternatively, and with appropriate geometric adjustments, be formed in any of the shapes described above in the context of FIGS. 3, 4, 5 and 6. It will also be appreciated that liner 424 could be formed in a shape having a lid, as illustrated in FIG. 11.

In FIG. 13, partition 425 is shown in a vertical orientation, and, just as in the manner of partition 25, partition 425 is variably positionable. About the upper portion of its periphery it has a strip engaging material 496 that catches on mating strips 497 and 498 located on the inner face of liner 424. These strips can be hook and eye fastener strips. The range of the strips permits the division of sub-compartments 427 and 429 of chamber 486 into equal, half-and half zones or portions, or into some other proportion of zones or portions, such as ¼ to ¾, ⅓ to ⅔, ⅖ to ⅗ and so forth as may be found desirable given the objects to be contained in chamber 486.

In FIG. 14, liner 424 is shown with partition 425 in a horizontal arrangement. Container 422 and liner 424 have been illustrated as having the same, or roughly the same, width and height, so that partition 425 can be used, as in FIG. 13, to divide chamber 486 into two zones separated by a vertical bulkhead or divider. Alternatively partition 425 can be used to divided chamber 486 into two zones separated by a horizontal, or roughly horizontal, floor or divider, or partition. In the latter case, the materials below the partition, such as cans, bottles or boxes, (not shown) support the partition, and the materials above rest upon the partition. Partition 425 is a relatively stiff panel, having a stiffener element that is insulated on both planar faces, and encased in a substantially water impermeable, and washable, external skin. The insulation material is a closed cell foam, generally similar to that used in the body of container 422. The plan form of partition 425 is generally rectangular, with rounded corners, to fit within the projected opening shape of liner 424 in close fitting relationship either in the vertical orientation of FIG. 13 or the horizontal configuration of FIG. 14.

While partition 425 is water impermeable, its fit within liner 424 is not water-tight. It is, however, a sufficient fit to tend to permit a measure of isolation, or environmental segregation, between the zones on either side of the partition from each other. When partition 425 is oriented to lie generally horizontally it may tend to permit cool materials to be carried in that portion of chamber 486 below partition 425, and warm or hot materials above, It may also tend to permit wet, or moist materials to be carried below partition 425 and relatively dry materials, such as bread or buns to be carried above. A vertical orientation of partition 425 may also tend to permit segregation into different zones of hot and cool for dry materials. In either orientation, the stiffness of partition 425 may tend to serve to provide softer materials, such as bread or fruit, with some protection from harder materials, such as bottles or cans that might otherwise crush them during the jostling of transportation.

Although only one partition 425 is illustrated, it would be possible to provide more than one such partition to permit division of the internal volume of the container into 3, 4 or more sub-compartments. It is also possible to provide a divider, or partition that, in generally horizontal orientation, only covers, or occludes, a portion of the chamber, in the manner of a partial shelf, or set of shelves. Such a partial divider may not tend to provide as effective a thermal barrier as a large partition that more closely matches the plan form of vertical section of the container. Notably, each of partitions 25 and 425, as illustrated and described, is mounted within its respective liner, 24 or 424.

Figure 15:
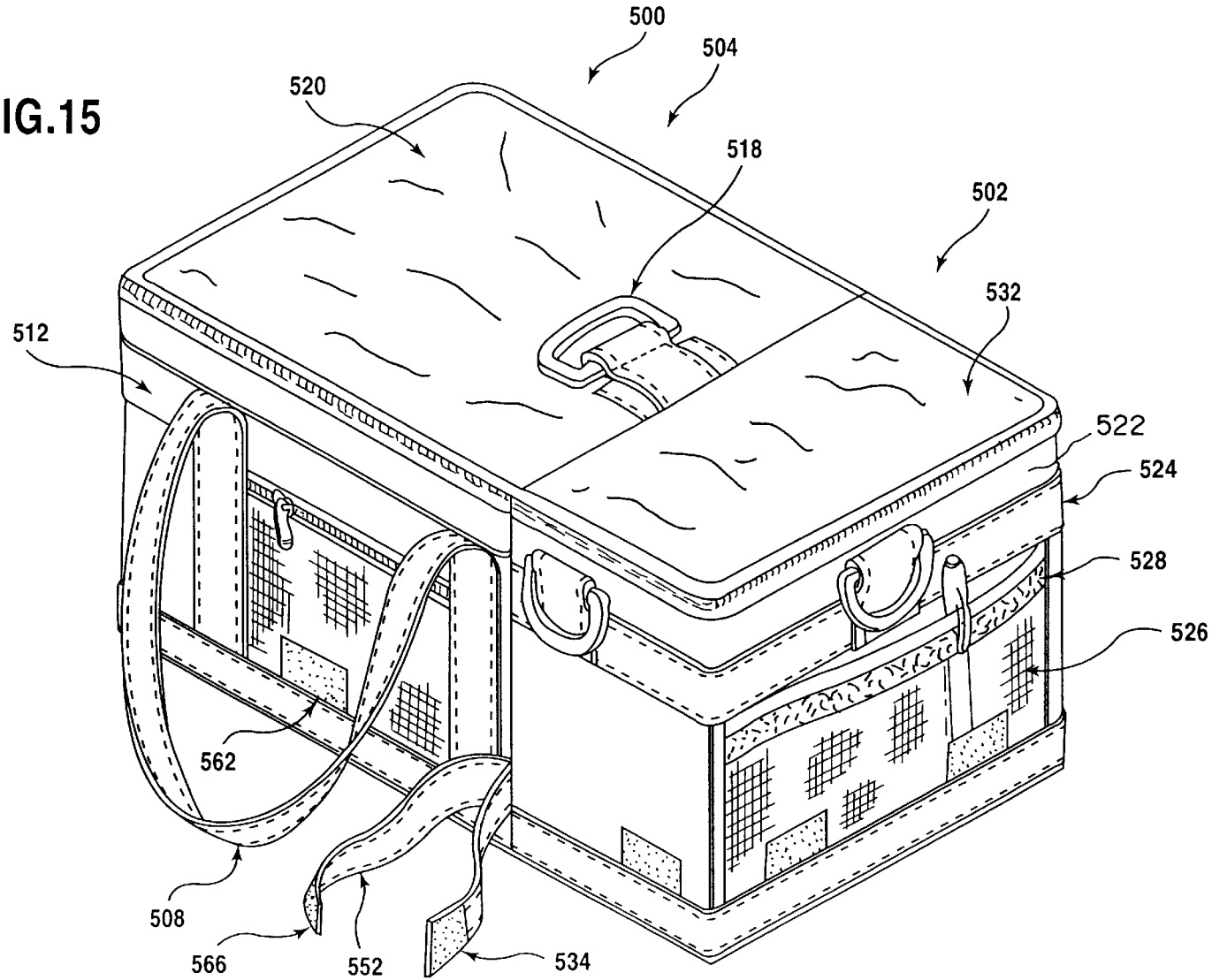
FIG. 15 shows an isometric view of a further alternative assembly to the assembly of FIG. 1.
Figure 16:
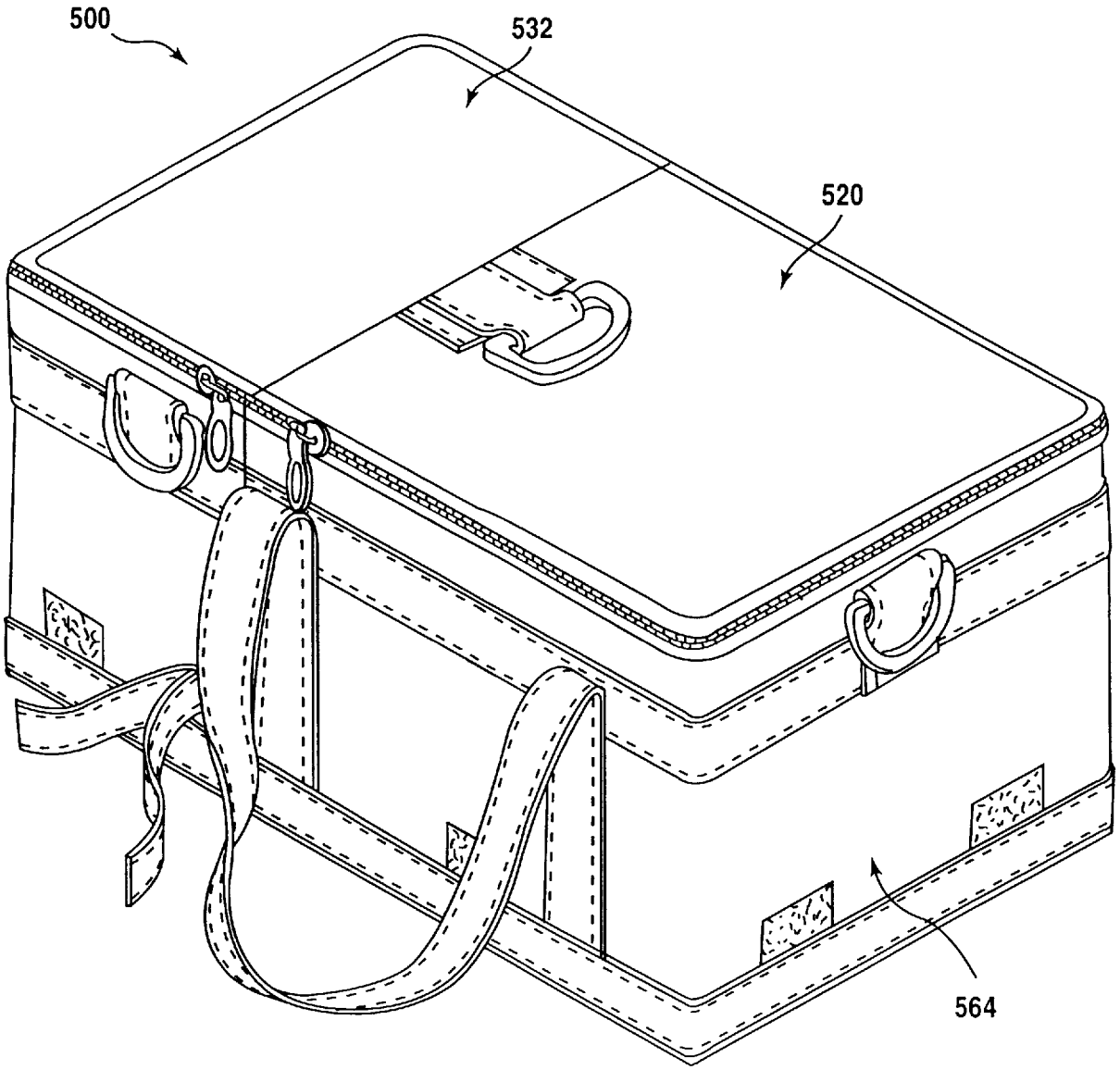
FIG. 16 shows an isometric view of the assembly of FIG. 15 taken from the diagonally opposite corner.
Figure 17:
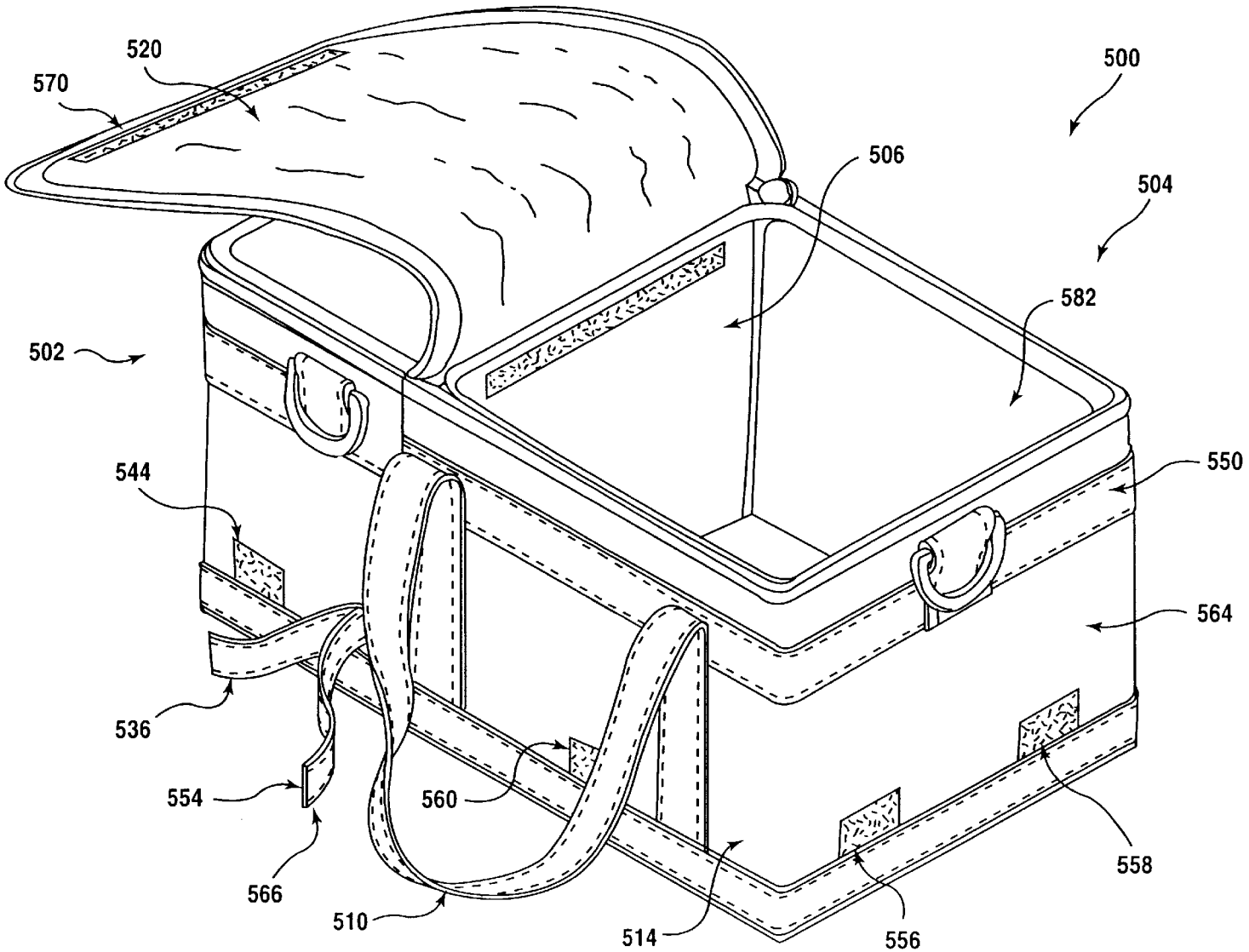
FIG. 17 shows the assembly of FIG. 15 with a lid to one chamber open.
Figure 18:
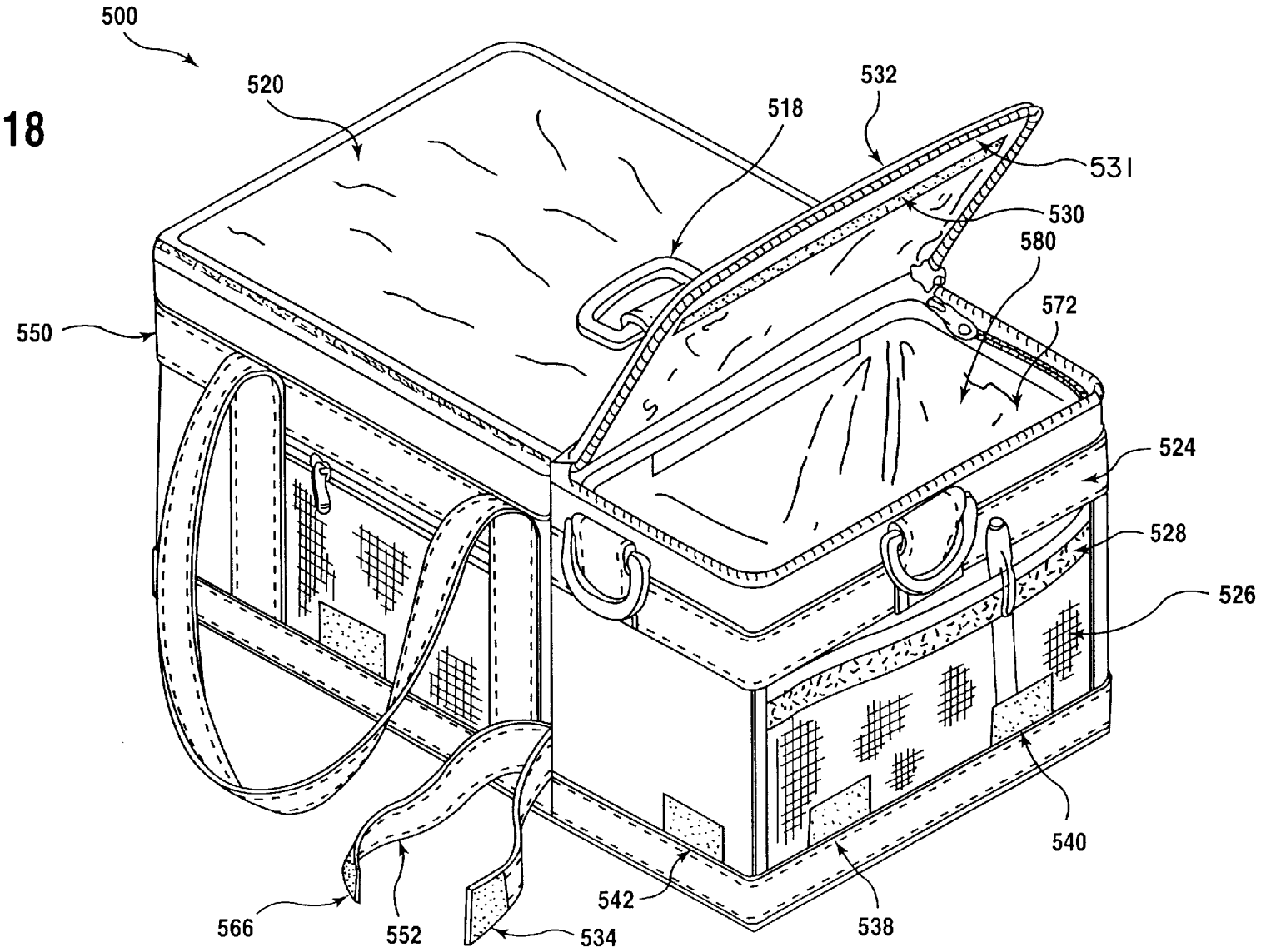
FIG. 18 shows the assembly of FIG. 15 with its opposite chamber open.
Figure 19:
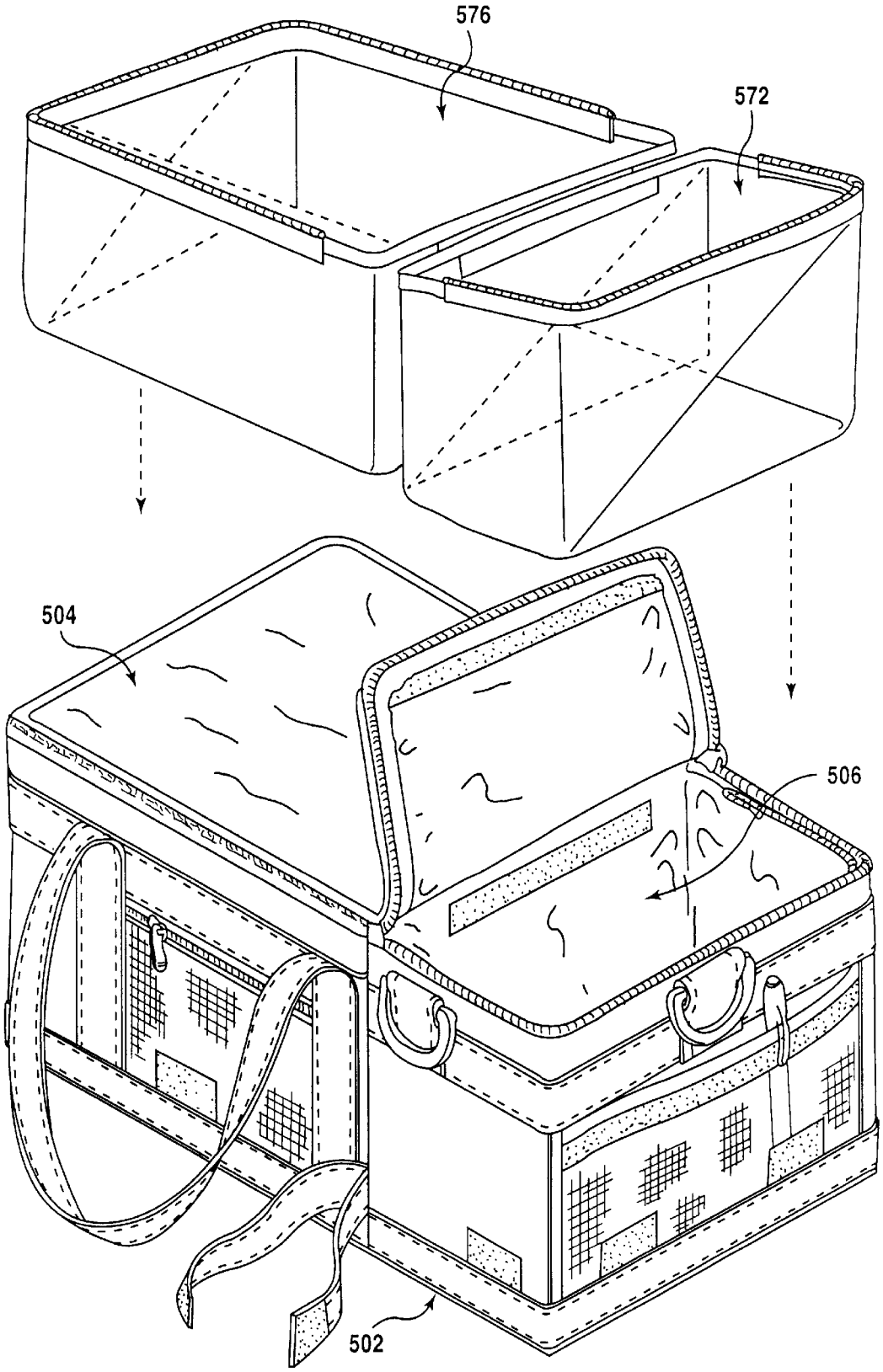
FIG. 19 shows the assembly of FIG. 15 with its liners removed.
Figure 20:
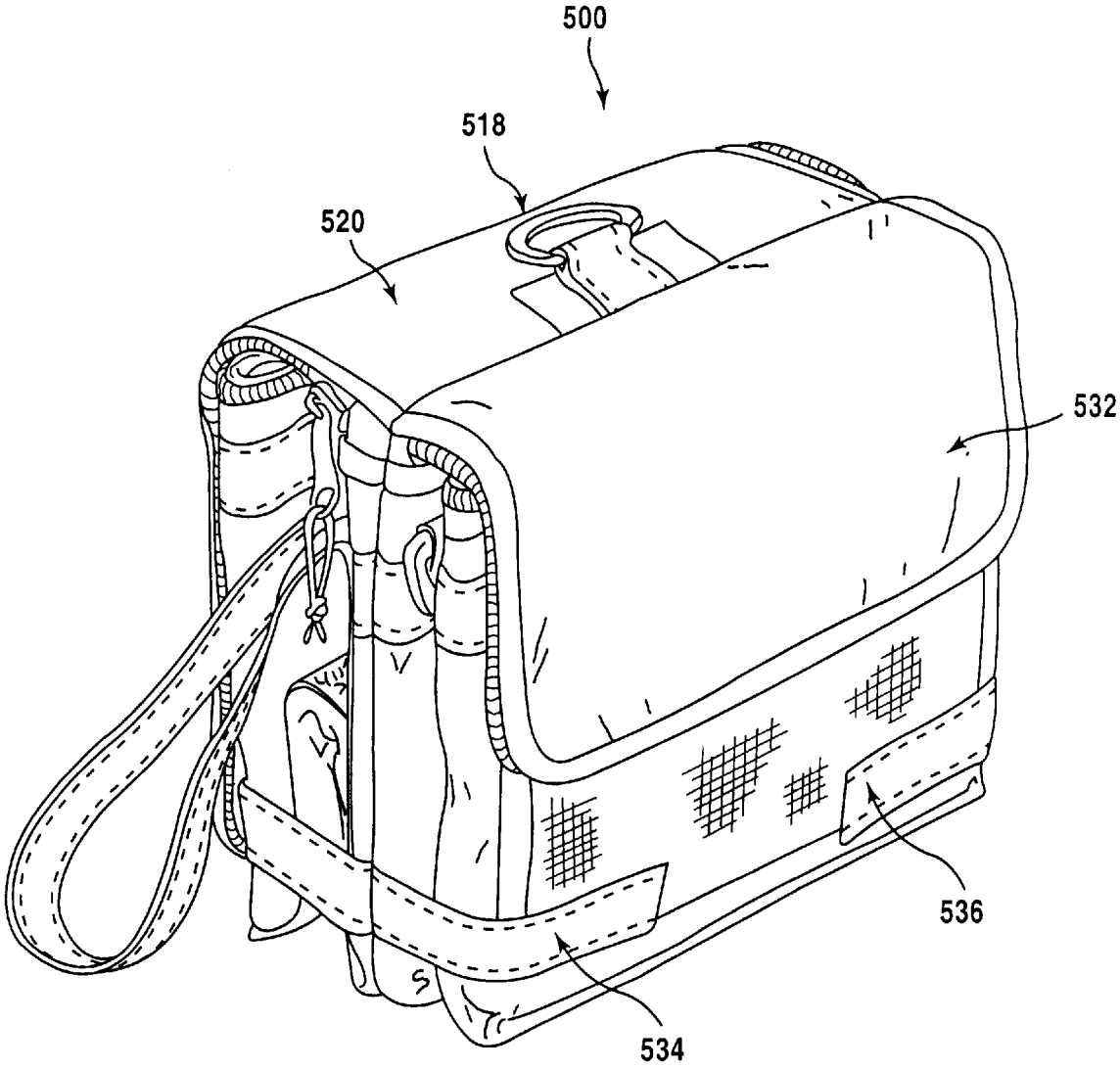
FIG. 20 shows the assembly of FIG. 15 in a collapsed position.
Figure 21:
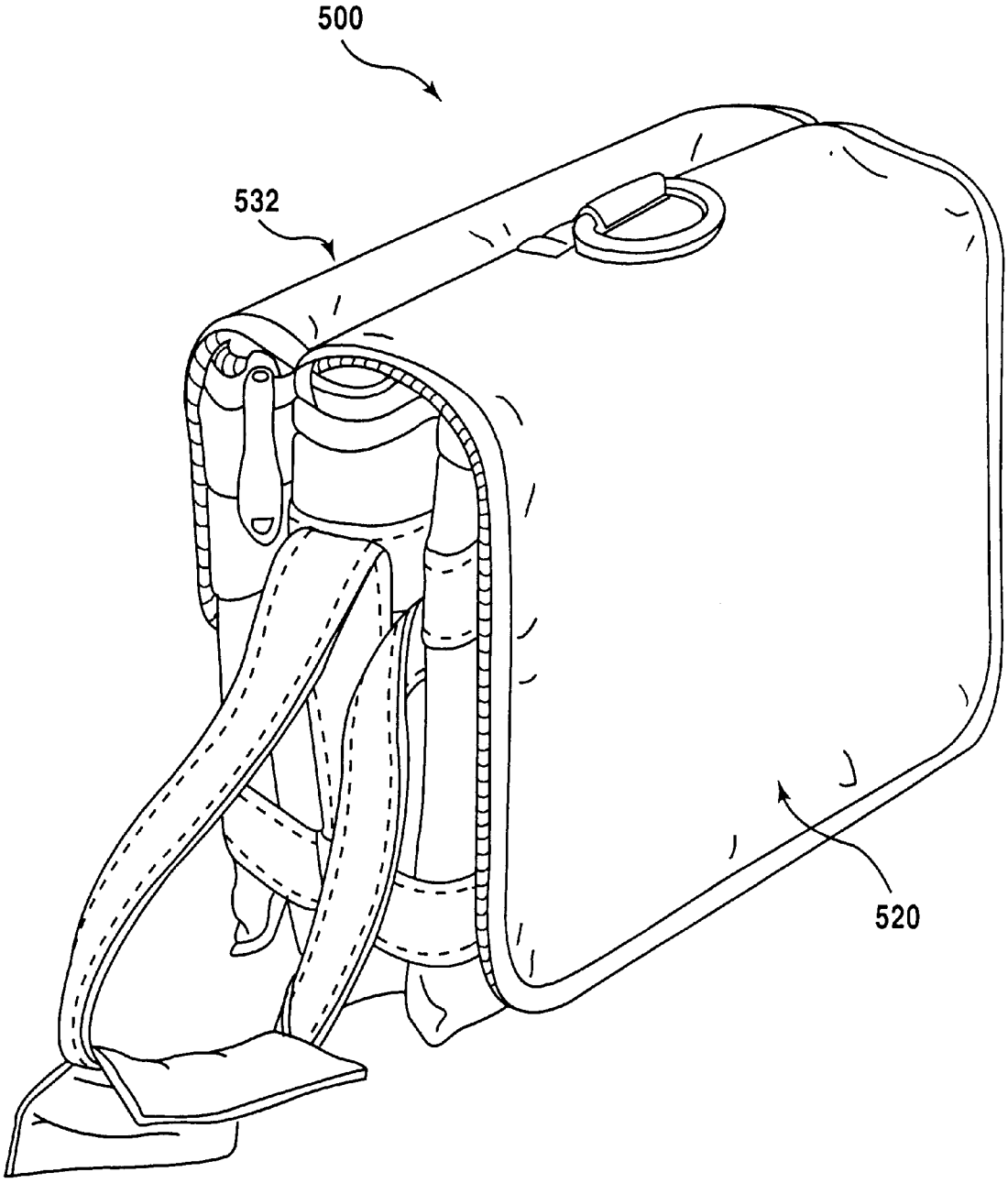
FIG. 21 shows the assembly of FIG. 15 in the collapsed position taken from the diagonally opposite corner to FIG. 20.
Figure 22:
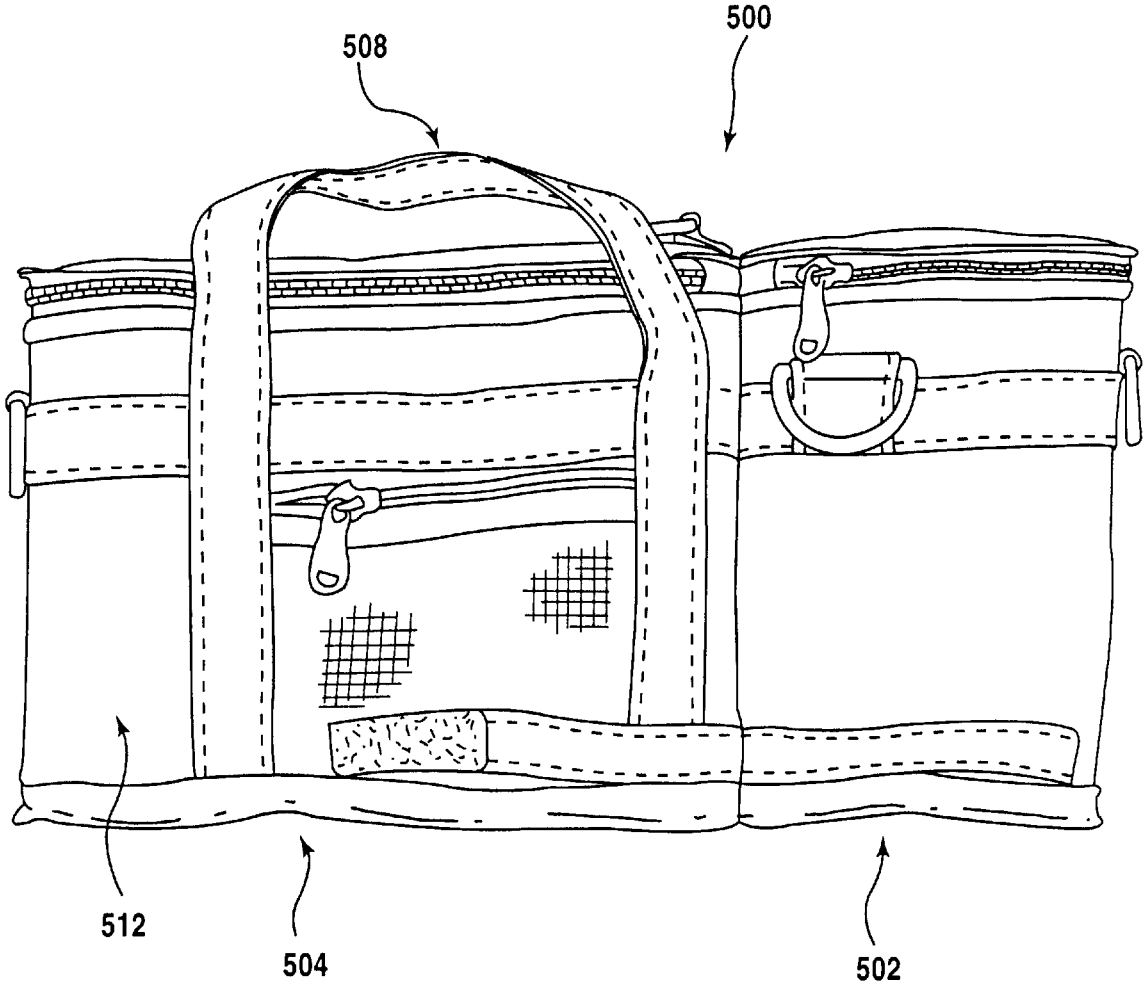
FIG. 22 shows a left-hand side elevation of the assembly of FIG. 15.
Figure 23:
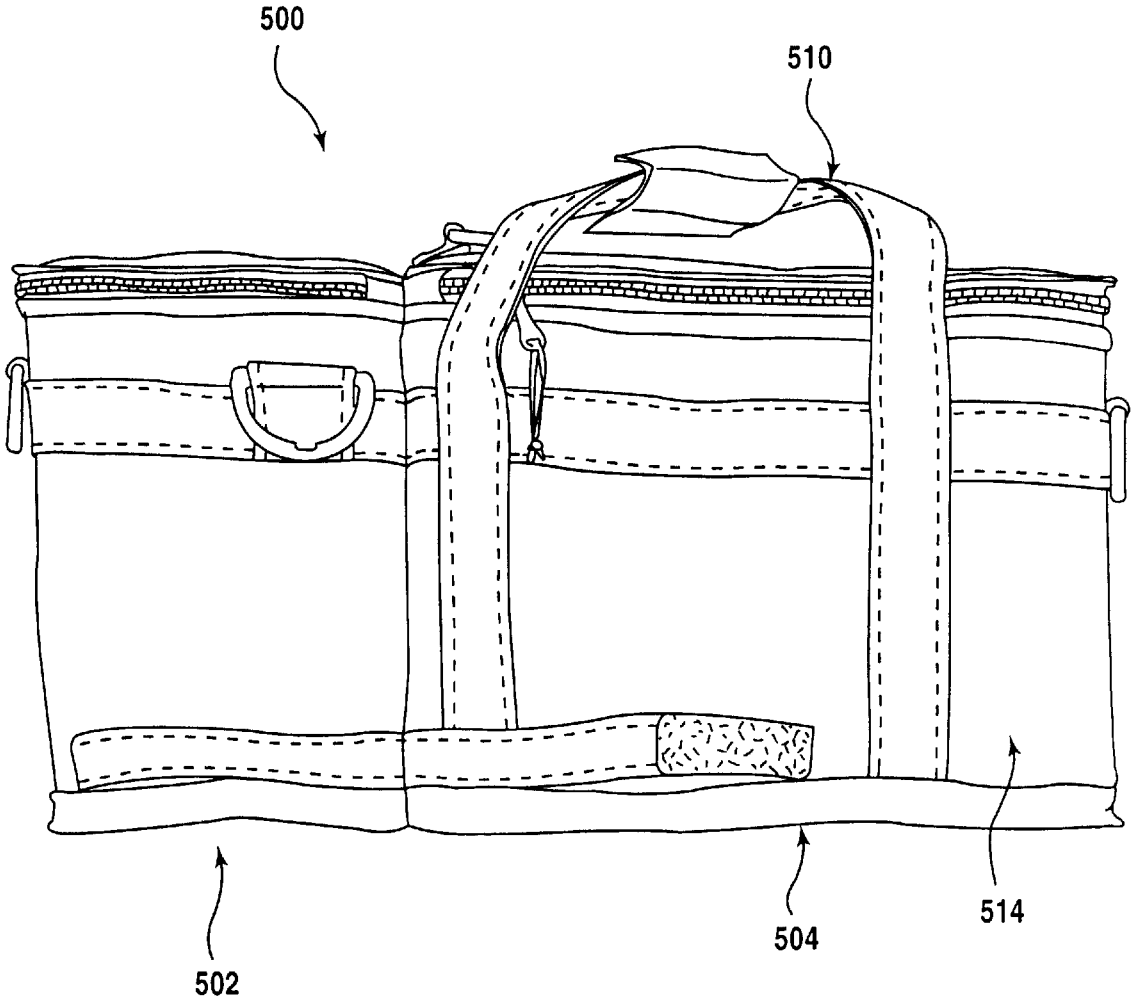
FIG. 23 shows a right-hand side elevation of the assembly of FIG. 15.
Figure 24:
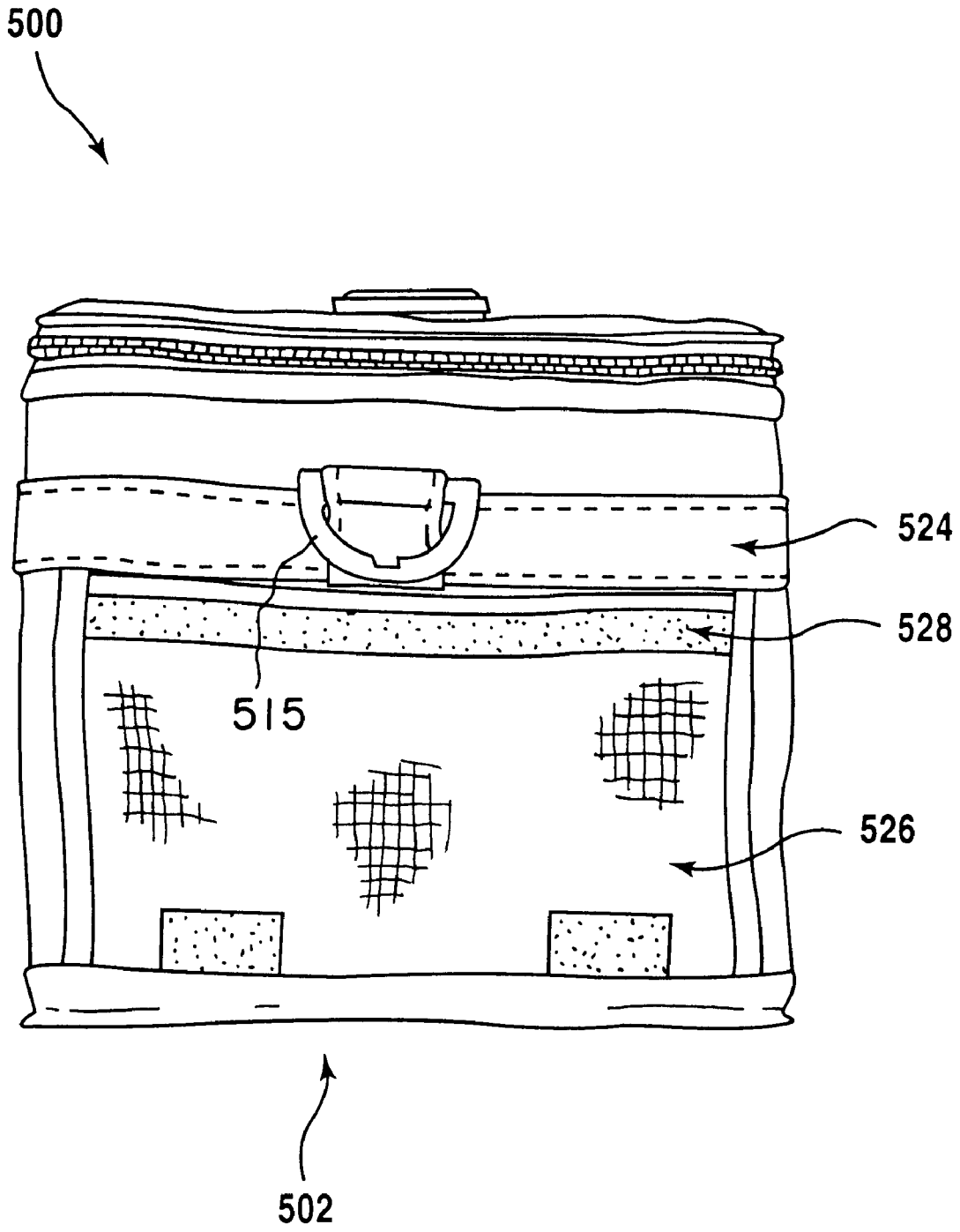
FIG. 24 shows a near end view of the assembly of FIG. 15.
Figure 25:
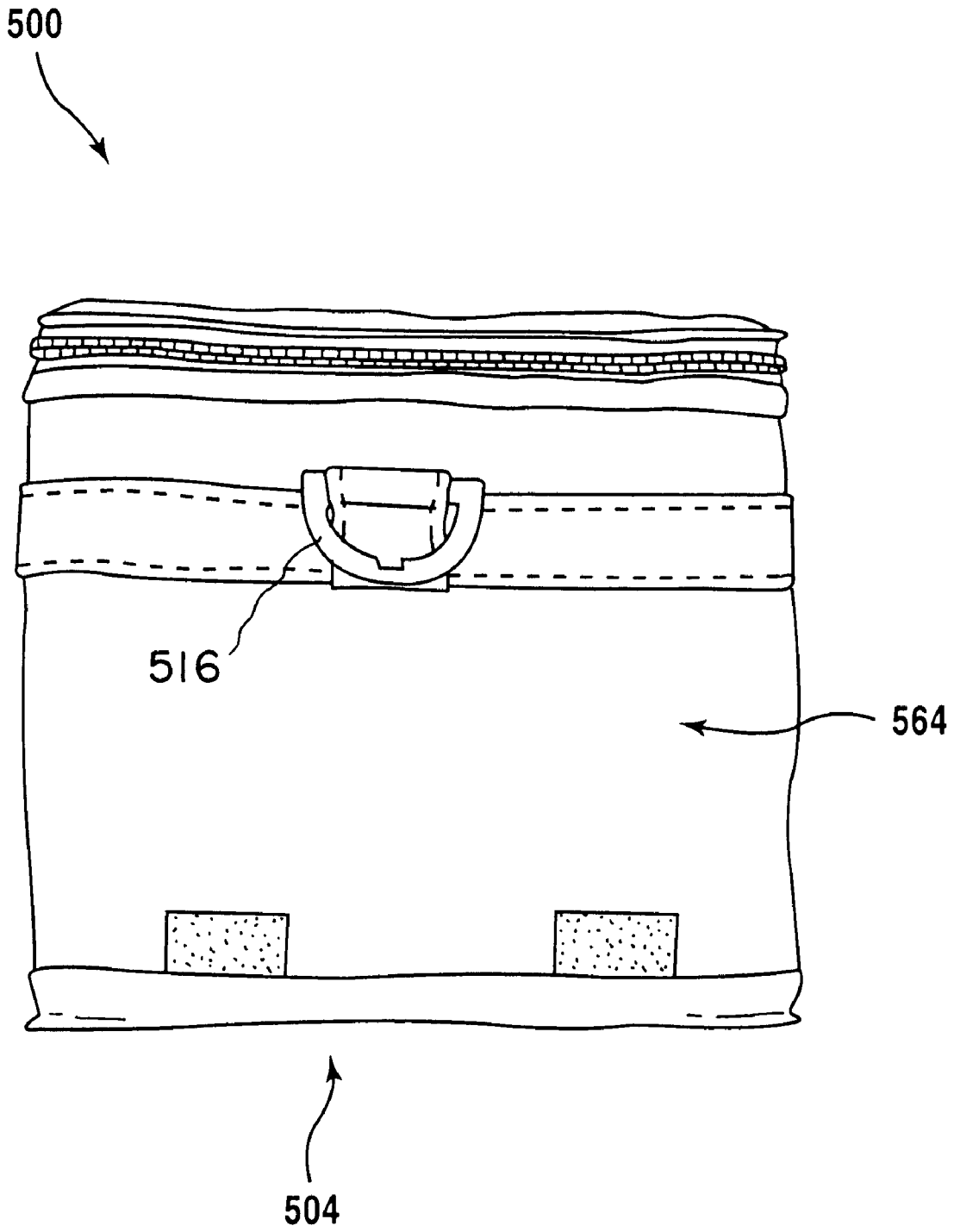
FIG. 25 shows a far end view of the assembly of FIG. 15.
Figure 26:
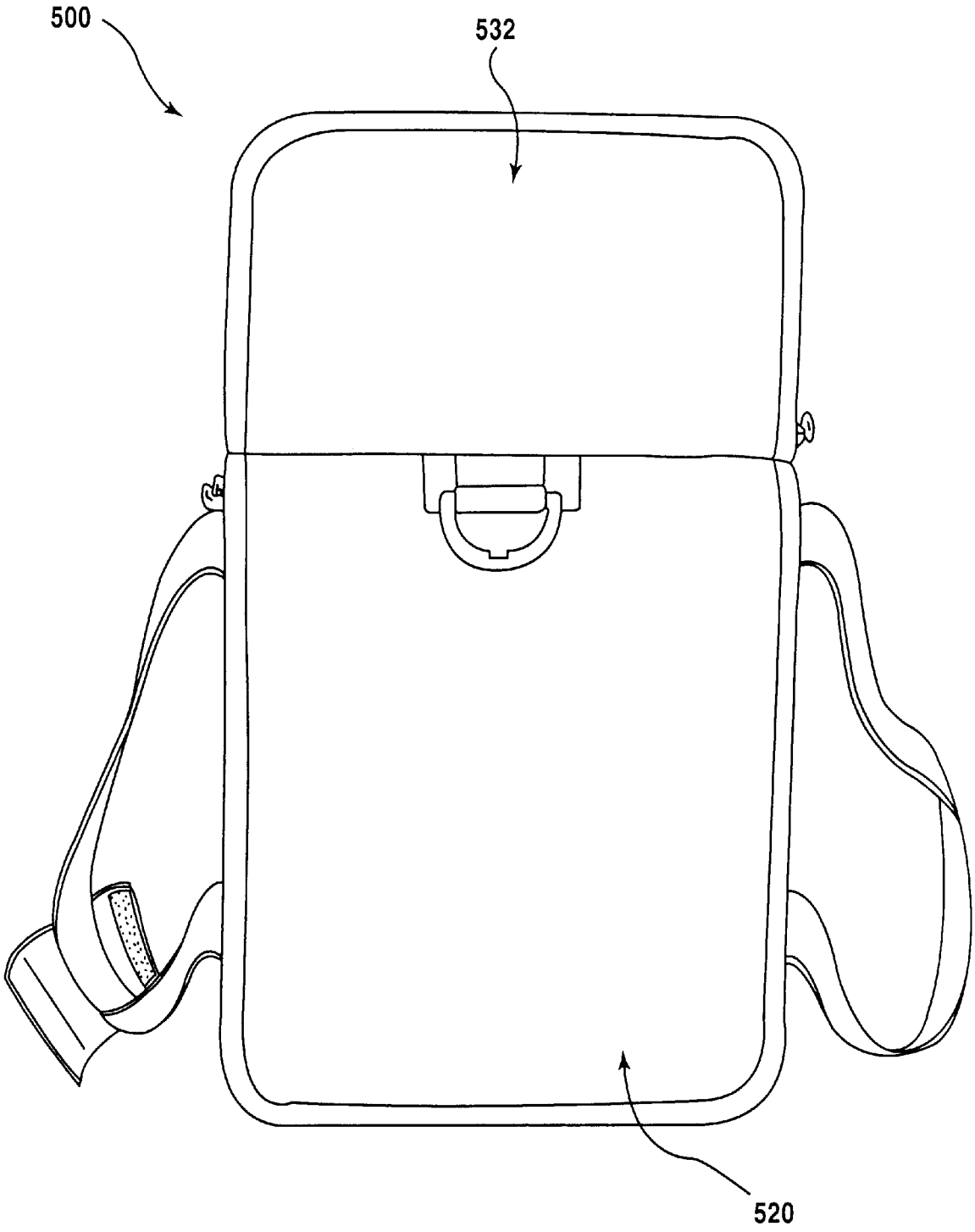
FIG. 26 shows a plan view of the assembly of FIG. 15.
Figure 27:
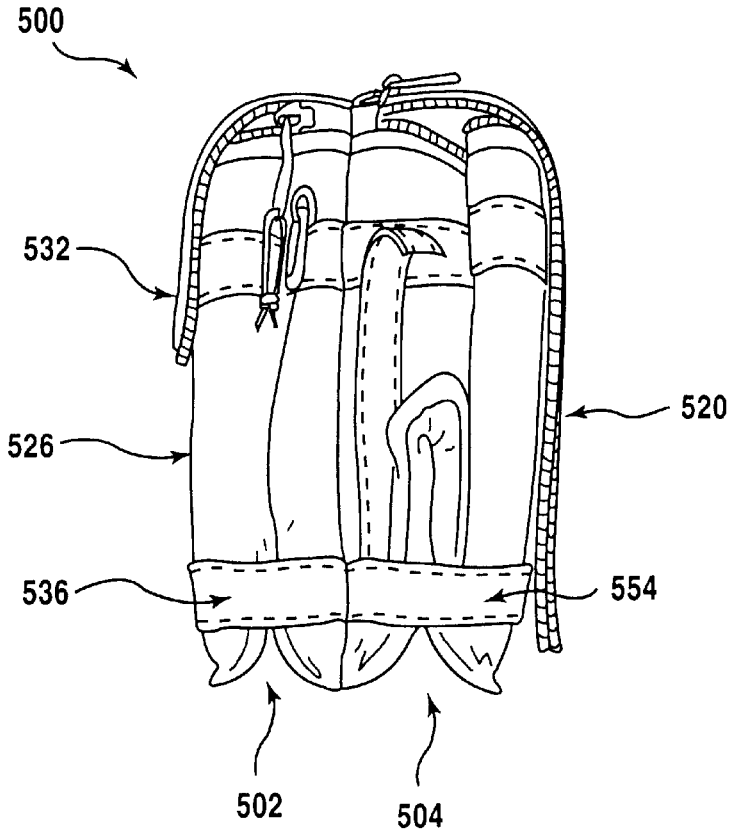
FIG. 27 shows a right-hand side elevation of the assembly of FIG. 20.
Figure 28:
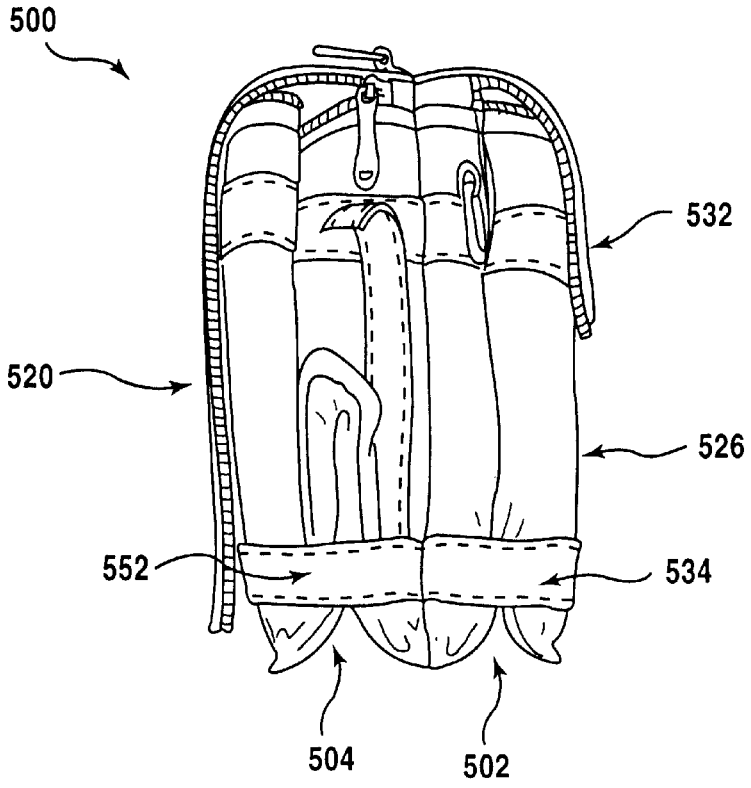
FIG. 28 shows a left-hand side elevation of the assembly of FIG. 20.
Figure 29:
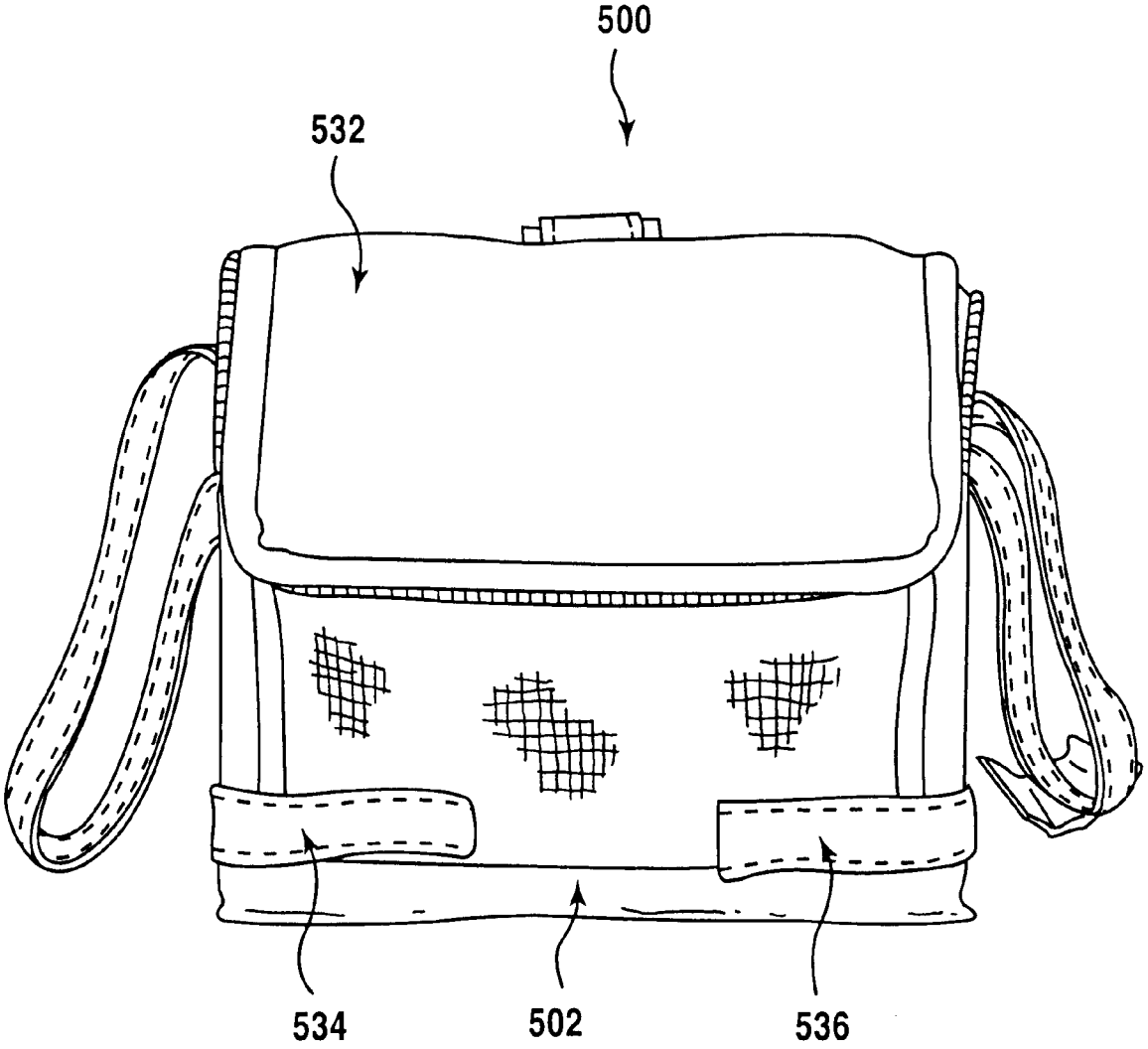
FIG. 29 shows a near end view of the assembly of FIG. 20.
Figure 30:
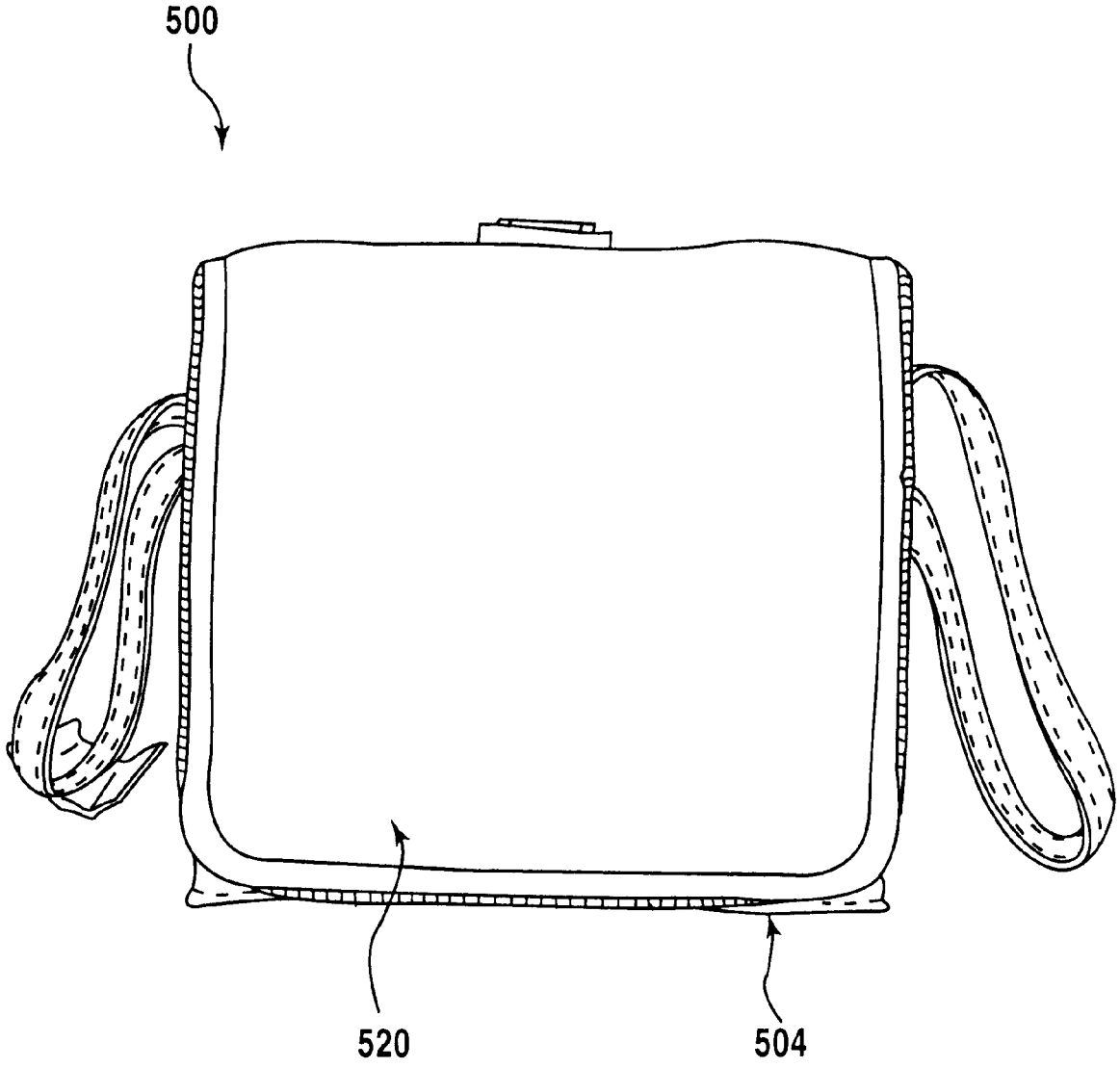
FIG. 30 shows a far end view of the assembly of FIG. 20.
Figure 31:
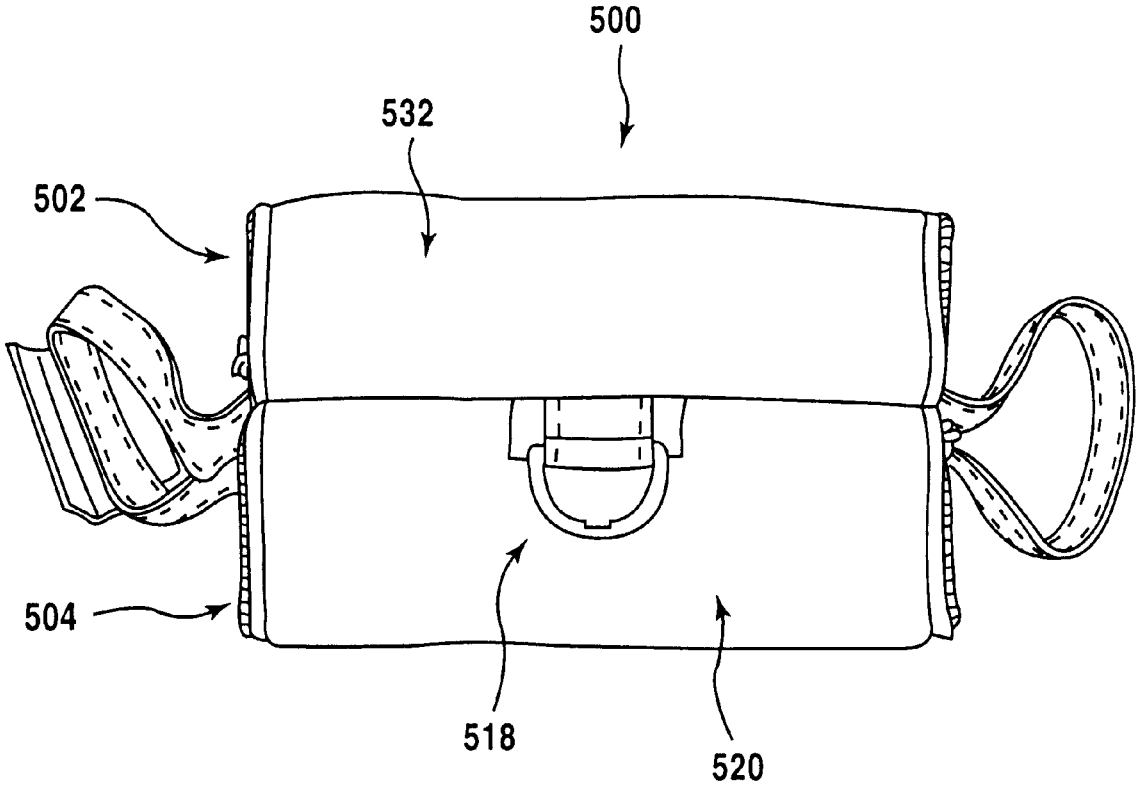
FIG. 31 shows a plan view of the assembly of FIG. 20.

FIGS. 15 through 31 show an alternative type of soft-sided, insulated wall, collapsible container assembly, indicated generally as 500. In the foreground of FIG. 15 it has a first container portion, indicated generally as 502 and a second container portion, indicated generally as 504. As illustrated first portion 502 is the same width and height as second portion 504, but is of lesser length. In the embodiment illustrated this difference is in the ratio of approximately 2:1, but could be greater or lesser, typically in the range of 1:1 to 5:1.

The basic lid, bottom, and sidewall construction of each of the first and second portions is the same as described above in the context of containers 22 and 422. Each has the general form of six-sided softwalled box, with portions 502 and 504 being joined at a common insulated wall 506 that is silvered on both sides. As with containers 22 and 422, a pair of left and right hand carrying handles 508 and 510 are provided, being mounted to main sidewall portions 512 and 514 of second portion 504. The front and rear faces each have a ring mounting 515, 516 to which a carrying strap, such as a shoulder strap, (not shown) can be attached. A top ring fitting 518 is mounted to the lid portion 520 of second portion 504, and is rooted in the joint between first and second portions 502 and 504.

End face 522 of first portion 502 has a peripheral strap 524, and a see through mesh pocket 526 in the manner of pocket 84 described above. A hook and eye fastener strip 528 is mounted laterally to pocket 526 adjacent to, and below its lip to provide an anchoring location for a mating fastener strap 530 mounted to the inner lip 531 of the inside face of lid portion 532 of first portion 502. First portion 502 also has a pair of storage fastening straps, in the nature of left and right hand side retainers 534 and 536 rooted in the main junction, that extend to engage either fastening strips 538 and 540 (similar to items 70 and 72, above) when in the collapsed position described above, or storage strips 542 and 544 (similar to items 74 and 76) when the cooler is in its expanded position.

Second portion 504 also has a peripheral strap, 550, side retainers 552 and 554, and collapsed and open position hook and eye fastener patches 556, 558, 560 and 562. End face 564 of second portion 504 does not have a lateral strip similar to strip 528. Instead, the outer end tang 566 of each of retainers 552 and 554 has a hook and eye fabric fastener patch on both inside and outside faces. In that way, when second portion 504 is collapsed, retainers 552 and 554 engage patches 560 and 562. Then lid portion 520 is drawn downwardly over end face 564 and a fastening strip 570 mounted inside the lip of lid portion 520 engages the outside face patches of tangs 566, and is retained in place by them.

Each of portions 502 and 504 is provided with a liner, 572 and 576 respectively, either or both of which can be provided with an insulated partition analogous to partition 425, as described above in the context of FIGS. 12, 13 and 14. it is not necessary that both portions 502 and 504 have a water-tight liner, since it may be that only one chamber is required for containing a wet object or objects. The double-cooler arrangement illustrated provides a fixed, water-tight barrier between one environment, that prevailing in chamber 580 of first portion 502, and another environment, that prevailing in chamber 582 of second portion 504. In the event that partitions are provided, those chamber can themselves be further divided. Although the relative sizes of chambers 580 and 582 are fixed, wall 506 provides a more substantial thermal barrier than the moveable partitions. Further, lid portions 520 and 532 provide separate access to the respective compartments, that is, chambers 580 and 582. Assembly 500, like assemblies 20 and 420 provides the combination of a liquid containment barrier for discouraging unwanted escape of liquid, and an environment segregation barrier by which to separate cool and cold, cold and hot, wet and dry, or soft and hard. However, in the former two cases, the physical segregation barrier, that is, partition 25 or 425, is mounted within the moisture containment barrier, that is either liner 28 or 428. In the latter instance whether or not there is also a moveable partition provided, the moisture containment barrier lies to one side of the dividing wall, in the nature of common wall 506.

A preferred embodiment has been described in detail and a number of alternatives have been considered. As changes in or additions to the above described embodiments may be made without departing from the nature, spirit or scope of the invention, the invention is not to be limited by or to those details, but only by the appended claims.

I claim:

1. A soft sided, collapsible, insulated container comprising:

a first collapsible insulated container portion, a second collapsible container portion and a common wall shared between said first and second container portions;

said first container portion having a first insulated wall structure defining a first enclosed chamber therewithin;

said first insulated wall structure having an opening defined therein, said opening permitting objects to enter or exit said first enclosed chamber, a portion of said first insulated wall structure being moveable to close said opening;

said second container portion having a second insulated wall structure defining a second enclosed chamber therewithin;

said common wall segregating said first and second enclosed chambers from each other:

said first chamber being maintainable at a different environmental condition from the environmental condition of said second chamber;

each of said insulated container portions having a liner for containing liquids mounted within its respective chamber.

2. A soft sided, collapsible, insulated container, comprising:

a first insulated container portion, a second container portion and a common wall shared between said first and second container portions;

said first insulated container portion having a first insulated wall structure defining a first enclosed chamber therewithin; said second container portion having a second insulated wall structure and a second enclosed chamber defined therewithin;

said common wall segregating said first and second chambers from each other;

said first chamber being maintainable at a different environmental condition from said second chamber;

said first insulated container portion having a liner for containing liquids mounted within said first enclosed chamber; said liner being removable from said first enclosed chamber;

said first container portion each being moveable between an expanded position and a collapsed position;

said container having fittings mounted to engage said first insulated container portion; said fittings being operable to maintain said first insulated container portion in said collapsed position.

3. The soft sided, collapsible container of claim 2 wherein said container has a partition member mounted within said liner.

4. The soft sided, collapsible container of claim 2 wherein:

each of said insulated container portions is moveable between respective expanded and collapsed positions;

said soft sided, collapsible container has fittings mounted to engage each of said first and second insulated container portions; and said fittings are operable to maintain each of said insulated container portions in its respective collapsed position.

5. The soft sided, collapsible container of claim 2 wherein:

said first insulated wall structure has a rectangular base, an upstanding wall having front, rear, left and right hand side portions extending upwardly of said rectangular base;

said rear portion of said upstanding wall has an upper margin distant from said base;

said moveable portion of first insulated wall structure is a top panel; and said top panel is hingedly attached to said upper margin of said rear portion of said upstanding wall.

6. The soft sided, collapsible container of claim 5 wherein said top panel is a lid and said lid is moveable between an open position and a closed position to control access to said first chamber.

7. The soft sided, collapsible container of claim 6 wherein said first insulated wall structure includes a closure member operable to secure said lid in said closed position.

8. A soft sided, collapsible, insulated container comprising:

a first collapsible insulated container portion, a second collapsible container portion and a common wall shared between said first and second container portions;

said first container portion having a first insulated wall structure defining a first enclosed chamber therewithin;

said first insulated wall structure having an opening defined therein, said opening permitting objects to enter or exit said first enclosed chamber, a portion of said first insulated wall structure being moveable to close said opening;

said second container portion having a second insulated wall structure defining a second enclosed chamber therewithin;

said common wall segregating said first and second enclosed chambers from each other;

said first chamber being maintainable at a different environmental condition from the environmental condition of said second chamber;

one of said insulated container portions having a liner for containing liquid mounted within its respective chamber;

said container having a partition member mounted within said liner.

9. The soft sided, collapsible container of claim 8 wherein said partition member includes a stiffening element.

10. A soft sided collapsible, insulated, container comprising:

a first collapsible insulated container portion, a second collapsible container portion and a common wall shared between said first and second container portions;

said first container portion having an insulated wall structure and a first chamber defined therewithin;

said second container portion having an insulated wall structure and a second chamber defined therewithin;

said common wall segregating said first and second chambers from each other;

said first chamber being maintainable at a different environmental condition from the environmental condition of said second chamber;

one of said insulated container portions having a liner for containing liquids mounted within its respective chamber and a partition member mounted within said liner;

said partition including a stiffening element, and a thermally insulative layer for discouraging heat transfer through said partition.

11. The soft sided collapsible container of claim 10 wherein the liner has fittings for engaging the partition, said partition being movable to a plurality of positions in engagement with said fittings.

12. The soft sided collapsible container of claim 11 wherein said respective chamber has a plan form section, said partition is moveable to lie in a horizontal orientation relative to said chamber, and, in said horizontal position, said partition has a shape to match said plan form section.

13. A soft sided collapsible container comprising:

a collapsible insulated wall structure having a chamber defined therewithin;

a removable liner for discouraging leakage of liquid from within said chamber;

said liner being folded from a monolithic sheet of liner stock, said liner having a lowest extremity and a lip, said liner being seamless to a height at least half way from said lowest extremity to said lip; and a segregation member located within said liner to define at least two sub-compartments therewithin.

14. The soft sided, collapsible container of claim 13 wherein:

said insulated wall structure has a rectangular base and sides extending upwardly therefrom;

each of said sides has a first edge adjoining said base and a second edge distant from said base;

said chamber has an opening defined between said second edges of said sides; and a portion of said insulated wall structure is moveable to close said opening.

15. The soft sided, collapsible container of claim 14 wherein:

said moveable portion of said insulated wall structure is a top panel;

said top panel is hingedly mounted to said distal edge of one of said sides; and said top panel is moveable between an open position and a closed position relative to said opening.

16. The soft sided, collapsible container of claim 15 further comprising a closure member mounted to said top panel; said closure member being operable to secure said top panel in said closed position.

17. The soft sided, collapsible container of claim 13 wherein said insulated wall structure has a second chamber defined therewithin; and said second chamber is maintainable at a different environmental condition from said first chamber.

18. The soft sided, collapsible container of claim 17 wherein said first chamber is segregated from said second chamber by a common wall; and said common wall has a thermal insulation layer for discouraging heat transfer therethrough.

19. The soft sided, collapsible container of claim 18 wherein said common wall has:

a first portion extending therefrom, moveable to restrict access to said first chamber; and a second portion extending therefrom, moveable to restrict access to said second chamber.

20. The soft sided, collapsible container of claim 19 wherein said first moveable portion and said second moveable portion are lid members; said lid members being moveable between an open and a closed position; said insulated wall structure having closure members to secure said lid members in said closed position.

21. A soft sided collapsible container comprising;

a collapsible insulated wall structure having a chamber defined therewithin;

a removable liner for discouraging leakage of liquid from within said chamber;

said liner having a lowest extremity and a lip, said liner being seamless to a height at least half way from said lowest extremity to said lip;

a segregation member located to divide said liner into at least two sub-compartments;

said liner having fittings for engaging said segregation member, said segregation member being movable to a plurality of positions in engagement with said fittings.

22. The soft sided, collapsible container of claim 21 wherein said segregation member is movable to at least one substantially vertical position for dividing said liner into sub-compartments lying horizontally adjacent to said segregation member.

23. The soft sided, collapsible container of claim 21 wherein said segregation member is movable to at least one substantially horizontal position for dividing said liner into sub-compartments lying above and below said segregation member.

24. The soft sided, collapsible container of claim 21 wherein said segregation member includes a stiffening element.

25. A soft sided, collapsible container comprising:

a collapsible insulated wall structure having a chamber defined therewithin;

a removable liner for discouraging leakage of liquid from within said chamber;

said liner having a lowest extremity and a lip, said liner being seamless to a height at least half way from said lowest extremity to said lip, and a segregation member mounted within said liner to define two at least two sub-compartments therewithin; said segregation member including a stiffening element, and a thermally insulative layer for discouraging heat transfer through said segregation member.

26. The soft sided, collapsible container of claim 25 wherein said liner has fittings for engaging said segregation member, said segregation number being movable to a plurality of positions in engagement with said fittings.

27. The soft sided, collapsible container of claim 26 wherein said respective chamber has a plan form section, said segregation member is moveable to lie in a horizontal orientation relative to said chamber, and, in said horizontal position, said segregation member has a shape to match said plan form section.

28. A soft sided, collapsible, insulated container comprising:

a first collapsible insulated container portion, a second collapsible container portion and a common wall shared between said first and second container portions;

said first container portion having a first insulated wall structure defining a first enclosed chamber therewithin;

said first insulated wall structure having an opening defined therein, said opening permitting objects to enter or exit said first enclosed chamber, a portion of said first insulated wall structure being moveable to close said opening;

said second container portion having a second insulated wall structure defining a second enclosed chamber therewithin;

said common wall segregating said first and second enclosed chambers from each other;

said first chamber being maintainable at a different environmental condition from the environmental condition of said second chamber;

each of said first and second insulated container portions is moveable between respective expanded and collapsed positions;

said soft sided, collapsible container has releasable fasteners mounted thereto for engaging each of said insulated container portions; and said releasable fasteners are operable to retain each of said insulated container portions in its respective collapsed position.

29. A soft sided, collapsible, insulated container comprising:

a first collapsible insulated container portion, a second collapsible container portion and a common wall shared between said first and second container portions;

said first container portion having a first insulated wall structure defining a first enclosed chamber therewithin;

said first insulated wall structure having an opening defined therein, said opening permitting objects to enter or exit said first enclosed chamber, a portion of said first insulated wall structure being moveable to close said opening;

said second container portion having a second insulated wall structure defining a second enclosed chamber therewithin;

said common wall segregating said first and second enclosed chambers from each other;

said first chamber being maintainable at a different environmental condition from the environmental condition of said second chamber;

one of said insulated container portions having a liner for containing liquid mounted within its respective chamber;

said liner being a monolithic liner having a base and sides; said base meeting said sides at folds defined in said liner.

* * * * *

UNITED STATES PATENT AND TRADEMARK OFFICE

CERTIFICATE OF CORRECTION

PATENT NO. : 6,234,677 B1
DATED : May 22, 2001
INVENTOR(S) : Melvin S. Mogil

It is certified that error appears in the above-identified patent and that said Letters Patent is hereby corrected as shown below:

Column 16,
Line 44, change “position” to -- orientation --.

Column 18,
Line 6, delete “two” (first occurrence).
Line 19, change “position” to -- orientation --.

Signed and Sealed this

Twenty-fourth Day of December, 2002

JAMES E. ROGAN
*Director of the United States Patent and Trademark Office*